US012365526B2

(12) United States Patent
Zacherle et al.

(10) Patent No.: US 12,365,526 B2
(45) Date of Patent: Jul. 22, 2025

(54) CARTON AND BLANK THEREFOR

(71) Applicant: WESTROCK PACKAGING SYSTEMS, LLC, Atlanta, GA (US)

(72) Inventors: Matthew E. Zacherle, Moseley (GA); Rahul Bhardwaj, Glen Allen, VA (US); Linh L. Kooc, Richmond, VA (US); Bradford J. Walling, Chesterfield, VA (US)

(73) Assignee: WestRock Packaging Systems, LLC, Atlanta, GA (US)

( * ) Notice: Subject to any disclaimer, the term of this patent is extended or adjusted under 35 U.S.C. 154(b) by 162 days.

(21) Appl. No.: 17/946,822

(22) Filed: Sep. 16, 2022

(65) Prior Publication Data

US 2023/0123888 A1 Apr. 20, 2023

Related U.S. Application Data

(63) Continuation of application No. 16/483,213, filed as application No. PCT/US2018/016560 on Feb. 2, 2018, now Pat. No. 11,447,317.

(60) Provisional application No. 62/473,974, filed on Mar. 20, 2017, provisional application No. 62/459,080, filed on Feb. 15, 2017, provisional application No. 62/454,106, filed on Feb. 3, 2017.

(51) Int. Cl.
*B65D 71/44* (2006.01)

(52) U.S. Cl.
CPC ..... *B65D 71/44* (2013.01)

(58) Field of Classification Search
CPC ..... B65D 71/50; B65D 71/44; B65D 71/504
USPC ..... 206/161, 145, 160
See application file for complete search history.

(56) References Cited

U.S. PATENT DOCUMENTS

| | | | |
|---|---|---|---|
| 2,823,062 | A | 2/1958 | Toensmeier |
| 2,929,181 | A | 3/1960 | Poupitch |
| 2,936,070 | A | 5/1960 | Poupitch |
| 3,137,109 | A | 6/1964 | Rapata |
| RE25,781 | E | 5/1965 | Akiereb |
| 3,317,234 | A | 5/1967 | Burford |
| 3,404,912 | A | 10/1968 | Watts |
| 3,432,202 | A | 3/1969 | Ebelhardt |
| 3,515,272 | A | 6/1970 | Gal |
| 3,601,253 | A | 8/1971 | Poupitch |
| 3,612,266 | A | 10/1971 | Graser |
| 3,627,121 | A | 12/1971 | Dessy |
| 3,664,497 | A | 5/1972 | Mascia |

(Continued)

FOREIGN PATENT DOCUMENTS

| | | |
|---|---|---|
| AU | 2009200835 A1 | 9/2009 |
| DE | 20201810653 | 1/2019 |

(Continued)

OTHER PUBLICATIONS

International Search Report and Written Opinion for corresponding International Patent Application No. PCT/US/2018/16560 dated May 23, 2018.

(Continued)

*Primary Examiner* — Steven A. Reynolds
(74) *Attorney, Agent, or Firm* — Brian J. Goldberg; Rohini K. Garg; Tsugihiko Suzuki

(57) ABSTRACT

The disclosure relates to a top engaging carrier formed from a paperboard substrate having a first surface and an opposing second surface, with a polymer film laminated onto the first surface.

14 Claims, 16 Drawing Sheets

(56) References Cited

U.S. PATENT DOCUMENTS

| | | | | | |
|---|---|---|---|---|---|
| 4,190,149 | A | | 2/1980 | Oliff et al. | |
| 4,518,081 | A | | 5/1985 | de Larosiere | |
| 4,911,289 | A | | 3/1990 | Bird | |
| 5,103,971 | A | | 4/1992 | Schuster | |
| 5,125,506 | A | | 6/1992 | Galbierz et al. | |
| 5,135,104 | A | | 8/1992 | Jorba | |
| 5,186,321 | A | | 2/1993 | Fadus | |
| 5,188,225 | A | * | 2/1993 | Jorba | B65D 71/46 206/148 |
| 5,320,216 | A | | 6/1994 | Pangborn | |
| 5,323,895 | A | | 6/1994 | Sutherland et al. | |
| 5,415,278 | A | | 5/1995 | Sutherland | |
| 5,474,172 | A | | 12/1995 | Zavatone et al. | |
| 5,485,914 | A | | 1/1996 | Martin | |
| 5,487,464 | A | | 1/1996 | Galbierz et al. | |
| 5,551,566 | A | * | 9/1996 | Sutherland | B65D 71/40 206/427 |
| 5,553,704 | A | | 9/1996 | Gordon et al. | |
| 5,553,705 | A | | 9/1996 | Bakx | |
| 5,573,111 | A | | 11/1996 | Gordon et al. | |
| 5,627,150 | A | | 5/1997 | Peterson et al. | |
| 5,706,936 | A | * | 1/1998 | Bernstein | B65D 71/44 206/148 |
| 5,711,419 | A | * | 1/1998 | Beales | B65D 71/40 206/148 |
| 5,718,330 | A | | 2/1998 | Auffret et al. | |
| 5,791,463 | A | | 8/1998 | Negelen | |
| 5,791,464 | A | | 8/1998 | Galbierz et al. | |
| 5,816,391 | A | * | 10/1998 | Harris | B65D 71/44 206/427 |
| 6,039,181 | A | * | 3/2000 | Whiteside | B65D 71/125 206/427 |
| 6,168,012 | B1 | | 1/2001 | Galbierz | |
| 6,293,392 | B1 | | 9/2001 | Galbierz | |
| 8,113,968 | B2 | | 2/2012 | Fittler | |
| 8,162,135 | B2 | | 4/2012 | Oliveira | |
| 9,004,344 | B2 | | 4/2015 | Smith | |
| D786,702 | S | | 5/2017 | Borg et al. | |
| 10,293,998 | B2 | | 5/2019 | Borg et al. | |
| 11,261,014 | B2 | * | 3/2022 | Zacherle | B65D 71/42 |
| 11,987,434 | B2 | * | 5/2024 | Garnier | B65D 71/42 |
| 2004/0007480 | A1 | | 1/2004 | Pattee et al. | |
| 2004/0134799 | A1 | | 7/2004 | Peterson et al. | |
| 2007/0193889 | A1 | | 8/2007 | Olsen et al. | |
| 2016/0159546 | A1 | | 6/2016 | Cassidy et al. | |
| 2016/0280436 | A1 | | 9/2016 | Taylor et al. | |
| 2018/0222650 | A1 | * | 8/2018 | Zacherle | B65D 71/50 |
| 2018/0362234 | A1 | | 12/2018 | LHeureux et al. | |
| 2020/0010255 | A1 | * | 1/2020 | Zacherle | B65D 71/42 |

FOREIGN PATENT DOCUMENTS

| | | | |
|---|---|---|---|
| EP | 0011274 | A | 5/1980 |
| EP | 0398835 | B1 | 10/1996 |
| EP | 2067713 | A1 | 6/2009 |
| ES | 2159235 | | 9/2001 |
| JP | H07 505598 | A | 6/1995 |
| JP | H10 218228 | A | 8/1998 |
| WO | WO2009023822 | A1 | 2/2009 |
| WO | WO2016/008744 | A1 | 1/2016 |
| WO | WO2017192471 | A1 | 11/2017 |

OTHER PUBLICATIONS

Japanese Decision on Rejection dated Aug. 22, 2022.
Korean Decision on Rejection dated Sep. 15, 2023.

* cited by examiner

FIGURE 14A
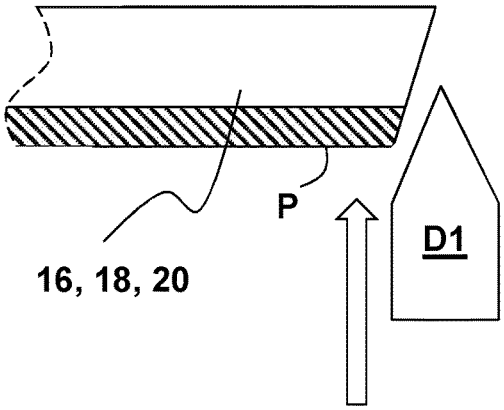
FIGURE 14B
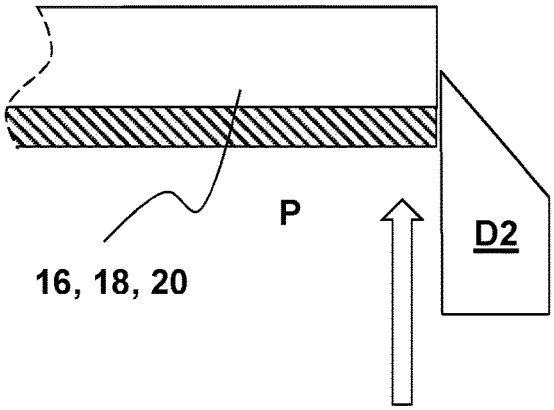
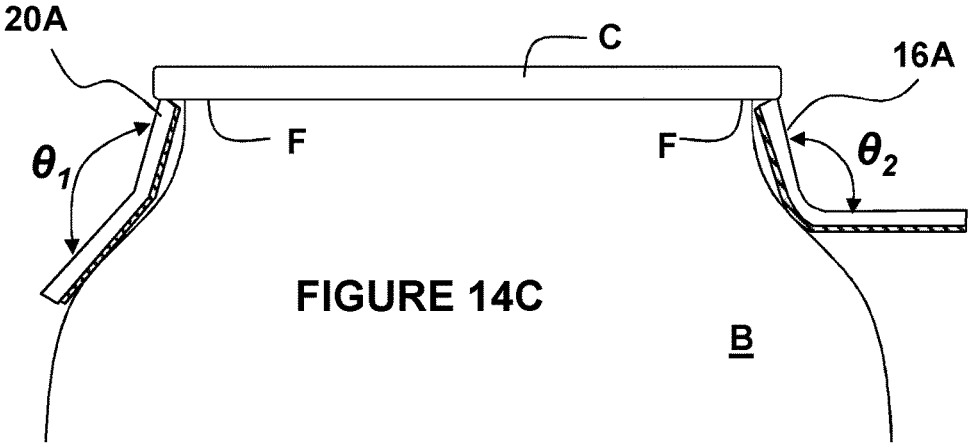
FIGURE 14C
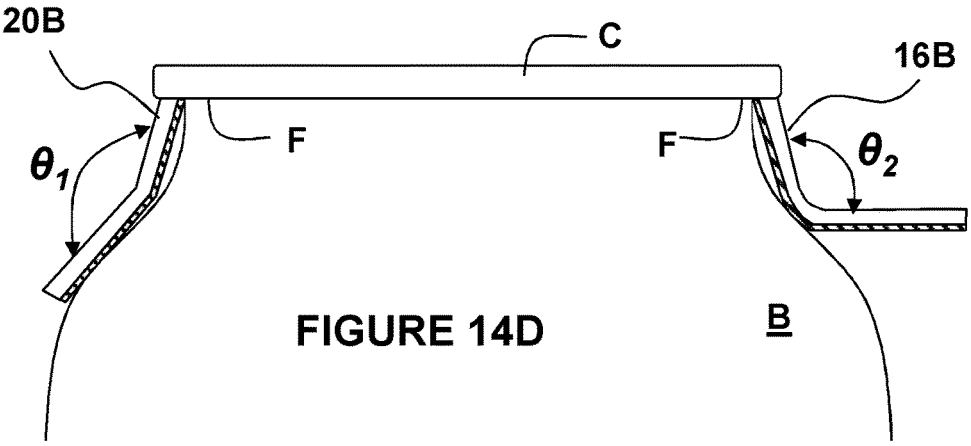
FIGURE 14D

CARTON AND BLANK THEREFOR

CROSS-REFERENCE TO RELATED APPLICATIONS

This application is a continuation of U.S. patent application Ser. No. 16/483,213, filed on Aug. 2, 2019, which is a national stage application under 35 U.S.C. § 371 of International Patent Application No. PCT/US2018/016560, filed on Feb. 2, 2018, which claims the benefit of priority under 35 U.S.C. § 119(e) to U.S. Provisional Patent Application Ser. No. 62/454,106 filed on Feb. 3, 2017; U.S. Provisional Patent Application Ser. No. 62/459,080 filed on Feb. 15, 2017 and U.S. Provisional Patent Application Ser. No. 62/473,974 filed on Mar. 20, 2017, all of which are hereby incorporated herein by reference in their entirety.

TECHNICAL FIELD

The present invention relates to cartons and to blanks for forming the same. More specifically, but not exclusively, the invention relates to a carrier of the top-gripping type having one or more apertures for receiving and retaining an article therein.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is well known to provide top gripping article carriers in which an aperture is formed in a panel of the carrier, wherein tabs are struck from said aperture. The tabs are displaced out of the plane of said panel when an article is received in the aperture, wherein said tabs engage the article generally about a flange or lip of the article.

The present invention seeks to provide an improvement in the field of cartons, typically formed from paperboard or the like.

SUMMARY

A first aspect of the invention provides a top engaging carrier for packaging one or more articles, comprising a main panel which comprises at least one aperture for receiving a portion of an article. The main panel further comprises an annular series of tabs formed around the aperture, the aperture defining a first edge of the tabs. The tabs of the annular series are hingedly connected to the main panel such that the tabs yield out of the plane of the main panel when an article is received in the aperture so as to bear against the article. At least one tab of the annular series is defined at least in part by a first cutline extending from the aperture into the main panel. The first cutline separates at least a portion of the at least one tab from an adjacent tab. The main panel comprises a second cutline, the second cutline being spaced apart from the first cutline and defining a portion of a second edge of each of the at least one tab and the adjacent tab, wherein the second edge opposes the first edge.

Optionally, the first cutline extends substantially radially from the aperture.

Optionally, the second cutline is circumferentially arranged with respect to the aperture.

Optionally, the at least one tab is connected to the adjacent tab by a connecting portion proximate the second cutline.

Optionally, the second cutline forms a stress relief mechanism.

Optionally, at least two tabs of the annular series are spaced apart from one another by a cutout placed between each tab and a next adjacent tab. Each cutout is defined by a pair of opposing side edges and by a curved end edge extending between the side edges. The curved end edge is disposed at a location furthermost from the center of the respective aperture, wherein the opposing side edges are divergently arranged with respect to each other.

A second aspect of the invention provides a top engaging carrier for packaging one or more articles comprising a main panel, which comprises at least one aperture for receiving a portion of an article. The main panel further comprises an annular series of tabs formed around the aperture, the aperture defining a first edge of the tabs. The tabs of the annular series are hingedly connected to the main panel such that the tabs yield out of the plane of the main panel when an article is received in the aperture so as to bear against the article. At least one tab of the annular series is defined at least in part by a radial cutline defined in the main panel, the radial cutline separating at least a portion of the at least one tab from an adjacent tab. The main panel comprises a circumferential cutline, the circumferential cutline being spaced apart from the radial cutline and defining a portion of a second edge of the at least one tab and the adjacent tab. The second edge opposes the first edge.

A third aspect of the invention provides a top engaging carrier for packaging one or more articles comprising a main panel which comprises at least one aperture for receiving a portion of an article, and a plurality of tabs forming an annular series around the aperture. The aperture defines a first edge of the tabs; each of the plurality of tabs is hingedly connected to the main panel such that each tab yields out of the plane of the main panel when an article is received in the aperture so as to bear against the article. At least one first tab of the plurality of tabs is defined at least in part by a first cutline extending from the aperture into the main panel. The first cutline separates at least a portion of the one or more first tabs from an adjacent tab. The main panel comprises at least one second cutline. The at least one second cutline is spaced apart from a respective one of the first cutlines and defines a portion of a second edge of the at least one first tab and the adjacent tab. The second edge opposes the first edge. At least one second tab of the plurality of tabs is defined at least in part by a first cutline extending from the aperture into the main panel. The first cutline separates at least a portion of the at least one second tab from an adjacent tab. The main panel comprises at least one third cutline, the at least one third cutline being spaced apart from a respective one of the first cut lines and defining a portion of a second edge of the at least one second tab and the adjacent tab. The second edge opposes the first edge. The at least one third cutline is larger in dimension than the at least one second cutline.

Optionally, the at least one second cutline is arcuate in shape.

Optionally, the at least one third cutline is arcuate in shape.

Optionally, the radius of curvature of the at least one third cutline is greater than the radius of curvature of the at least one second cutline.

Optionally, the at least one third cutline is longer than the at least one second cutline.

Optionally, at least one first tab is defined in part by a fourth cutline defining a fold line about which the at least one first tab yields when folded out of the plane of the main panel by insertion of an article into the aperture.

Optionally, the top engaging carrier comprises an asymmetric cutline defined in the main panel, the asymmetric cutline being spaced apart from a first cutline separating one of the at least one first tabs from one of the at least one second tabs. The asymmetric cutline is spaced apart from said first cutline and defines a portion of a second edge of said one of the at least one first tabs and said one of the at least one second tabs. The second edge opposes the first edge.

A fourth aspect of the invention provides a blank for forming a carrier. The blank comprises a main panel which comprises at least one aperture for receiving a portion of an article, the main panel further comprising an annular series of tabs formed around the aperture. The aperture defines a first edge of the tabs, the tabs of the annular series being hingedly connected to the main panel such that the tabs yield out of the plane of the main panel when an article is received in the aperture so as to bear against the article. At least one tab of the annular series is defined at least in part by a first cutline extending from the aperture into the main panel. The first cutline separates at least a portion of the at least one tab from an adjacent tab. The main panel comprises a second cutline, the second cutline being spaced apart from the first cutline and defining a portion of a second edge of each of the at least one tabs and the adjacent tab, wherein the second edge opposes the first edge.

A fifth aspect of the invention provides a blank for forming a carrier. The blank comprises a main panel which comprises at least one aperture for receiving a portion of an article, the main panel further comprising an annular series of tabs formed around the aperture. The aperture defines a first edge of the tabs, the tabs of the annular series being hingedly connected to the main panel such that the tabs yield out of the plane of the main panel when an article is received in the aperture so as to bear against the article. At least one tab of the annular series is defined at least in part by a radial cutline defined in the main panel, the radial cutline separating at least a portion of the at least one tab from an adjacent tab. The main panel comprises a circumferential cutline, the circumferential cutline being spaced apart from the radial cutline and defining a portion of a second edge of the at least one tab and the adjacent tab. The second edge opposes the first edge.

A sixth aspect of the invention provides a blank for forming a carrier. The blank comprises a main panel which comprises at least one aperture for receiving a portion of an article. A plurality of tabs forms an annular series around the aperture, wherein the aperture defines a first edge of the tabs. Each of the plurality of tabs is hingedly connected to the main panel such that each tab yields out of the plane of the main panel when an article is received in the aperture so as to bear against the article. At least one first tab of the plurality of tabs is defined at least in part by a first cutline extending from the aperture into the main panel. The first cutline separates at least a portion of the one or more first tabs from an adjacent tab. The main panel comprises at least one second cutline, the at least one second cutline being spaced apart from a respective one of the first cutlines and defining a portion of a second edge of the at least one first tab and the adjacent tab. The second edge opposes the first edge. At least one second tab of the plurality of tabs is defined at least in part by a first cutline extending from the aperture into the main panel. The first cutline separates at least a portion of the at least one second tab from an adjacent tab. The main panel comprises at least one third cutline, the at least one third cutline being spaced apart from a respective one of the first cutlines and defining a portion of a second edge of the at least one second tab and the adjacent tab, the second edge opposing the first edge. The at least one third cutline is larger in dimension than the at least one second cutline.

A seventh aspect of the invention provides a carrier for packaging one or more articles comprising a main panel which comprises at least one aperture for receiving a portion of an article. The main panel further comprises an annular series of tabs formed around the aperture, the tabs of the annular series being hingedly connected to the main panel such that the tabs yield out of the plane of the main panel when an article is received in the aperture so as to bear against the article. At least one first tab of the annular series comprises a first width dimension. At least one second tab of the annular series comprises a second width dimension, the second width dimension being greater than the first width dimension.

Optionally, the at least one second tab is disposed in closer proximity to a free edge of the main panel than the at least one first tab.

An eighth aspect of the invention provides a blank for forming a carrier. The blank comprises a main panel which comprises at least one aperture for receiving a portion of an article, the main panel further comprising an annular series of tabs formed around the aperture. The tabs of the annular series are hingedly connected to the main panel such that the tabs yield out of the plane of the main panel when an article is received in the aperture so as to bear against the article. At least one first tab of the annular series comprises a first width dimension. At least one second tab of the annular series comprises a second width dimension, the second width dimension being greater than the first width dimension.

A ninth aspect of the invention provides top engaging carrier as described in the first aspect, formed from a paperboard substrate having a thickness between 20 to 35 mils, the paperboard substrate having a first surface and an opposing second surface, with a polymer film laminated onto the first surface, the polymer film having a thickness between 1 to 3 mils.

Optionally, the paperboard substrate comprises a wet strength additive.

Optionally, the first surface faces the lower portion of the articles.

Optionally, the polymer film is tear-resistant.

Optionally, the polymer film is polyethylene terephthalate.

Optionally, a second polymer film is attached to the second surface.

A tenth aspect of the invention provides a blank as in the fourth aspect, the blank formed from a paperboard substrate having a thickness between 20 to 35 mils, the paperboard substrate having a first surface and an opposing second surface, with a polymer film laminated onto the first surface, the polymer film having a thickness between 1 to 3 mils.

Optionally, the paperboard substrate comprises a wet strength additive.

Optionally, the polymer film is tear-resistant.

Optionally, the polymer film is polyethylene terephthalate.

Optionally, a second polymer film is attached to the second surface.

An eleventh aspect of the invention provides a carrier for engaging the top of at least one article, comprising a generally planar sheet comprising a paperboard substrate having a thickness between 20 to 35 mils and opposed first and second surfaces; a polymer film laminated onto the first surface, the polymer film having a thickness between 1 to 3 mils; and an aperture formed in the generally planar sheet for closely receiving the at least one article.

Optionally, the paperboard substrate comprises a wet strength additive.

Optionally, the first surface faces the lower portion of the article.

Optionally, the polymer film is tear-resistant.

Optionally, the polymer film is polyethylene terephthalate.

Optionally, a second polymer film is attached to the second surface.

Within the scope of this application it is envisaged that the various aspects, embodiments, examples, features and alternatives set out in the preceding paragraphs, in the claims and/or in the following description and drawings may be taken independently or in any combination thereof. For example, features described in connection with one embodiment are applicable to all embodiments unless there is incompatibility of features.

BRIEF DESCRIPTION OF THE DRAWINGS

Exemplary embodiments of the invention will now be described with reference to the accompanying drawings, in which:

FIG. 14A shows a dual bevel rule for cutting a carrier blank;

FIG. 14B shows a single bevel rule for cutting a carrier blank;

FIG. 14C shows a can inserted into a carrier cut with a dual bevel rule;

FIG. 14D shows a can inserted into a carrier cut with a single bevel rule, showing the PET edge of the carrier teeth closely engaging the can flange;

DETAILED DESCRIPTION OF EMBODIMENTS

Detailed descriptions of specific embodiments of the package, blanks and article carriers are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, blanks and article carriers described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Part 1—Structure

Figure 1A:
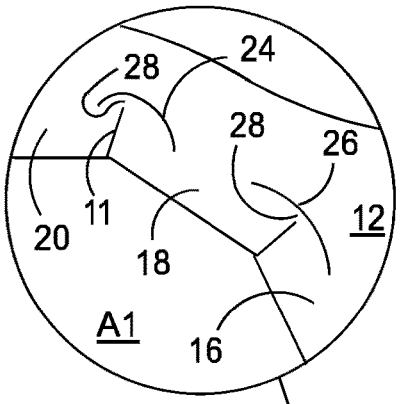
FIG. 1A is an enlarged view of a portion of the blank of FIG. 1.
Figure 1:
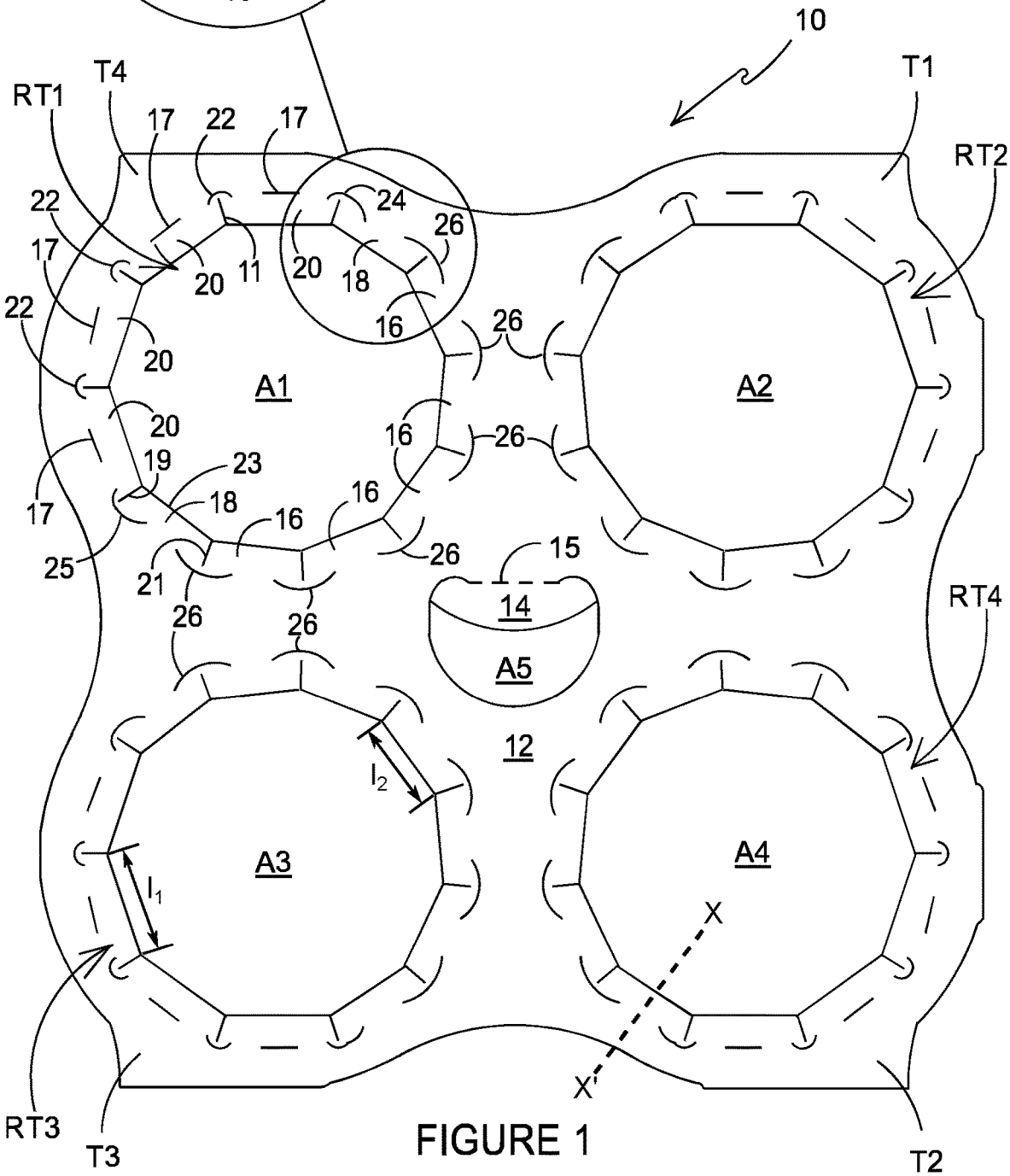
FIG. 1 is a plan view from above of a blank for forming an article carrier according to a first embodiment.
Figure 2:
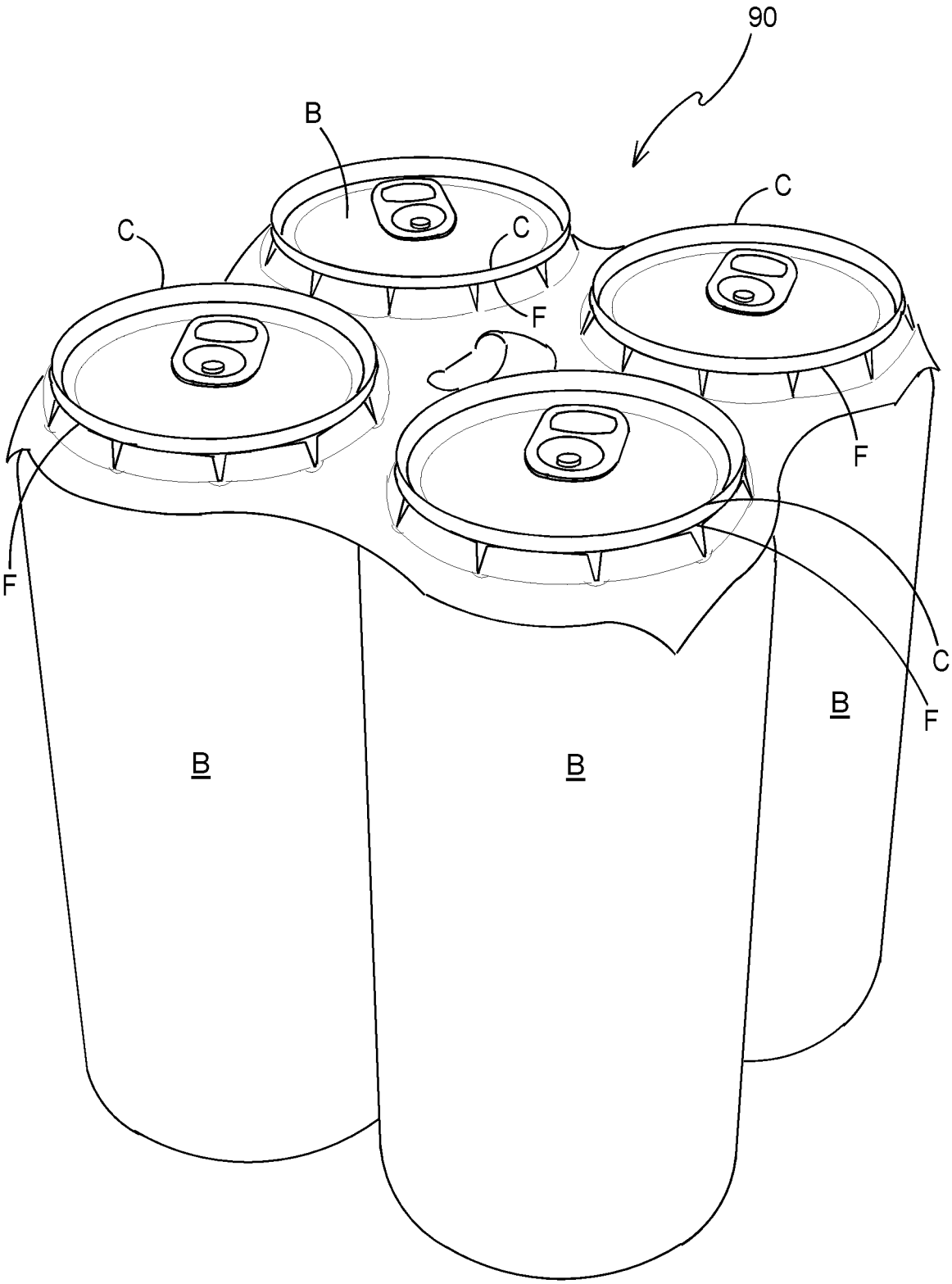
FIG. 2 is a perspective view from above of an article carrier formed from the blank of FIG. 1.
Figure 4:
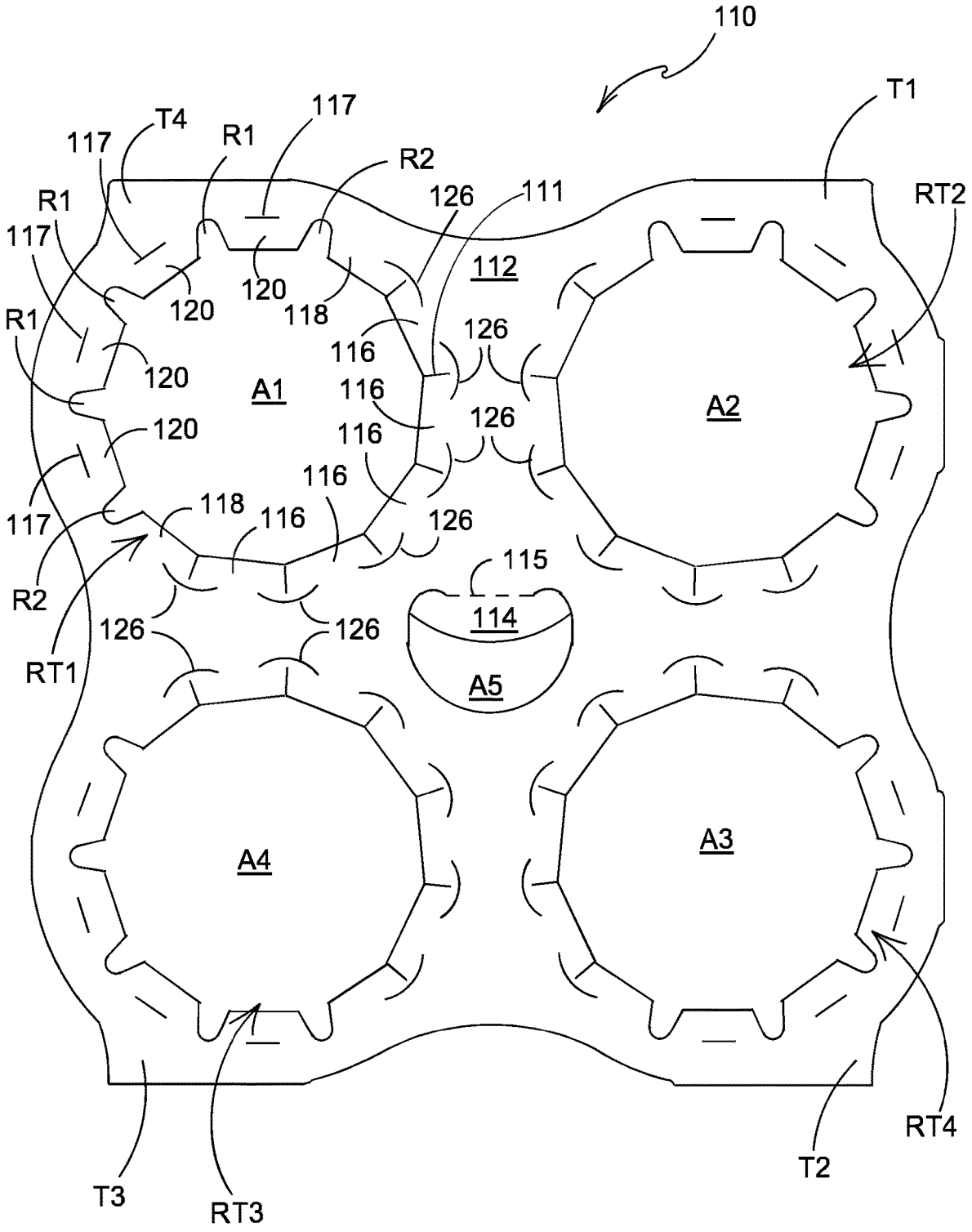
FIG. 4 is a plan view from above of a blank for forming an article carrier according to a second embodiment.
Figure 5:
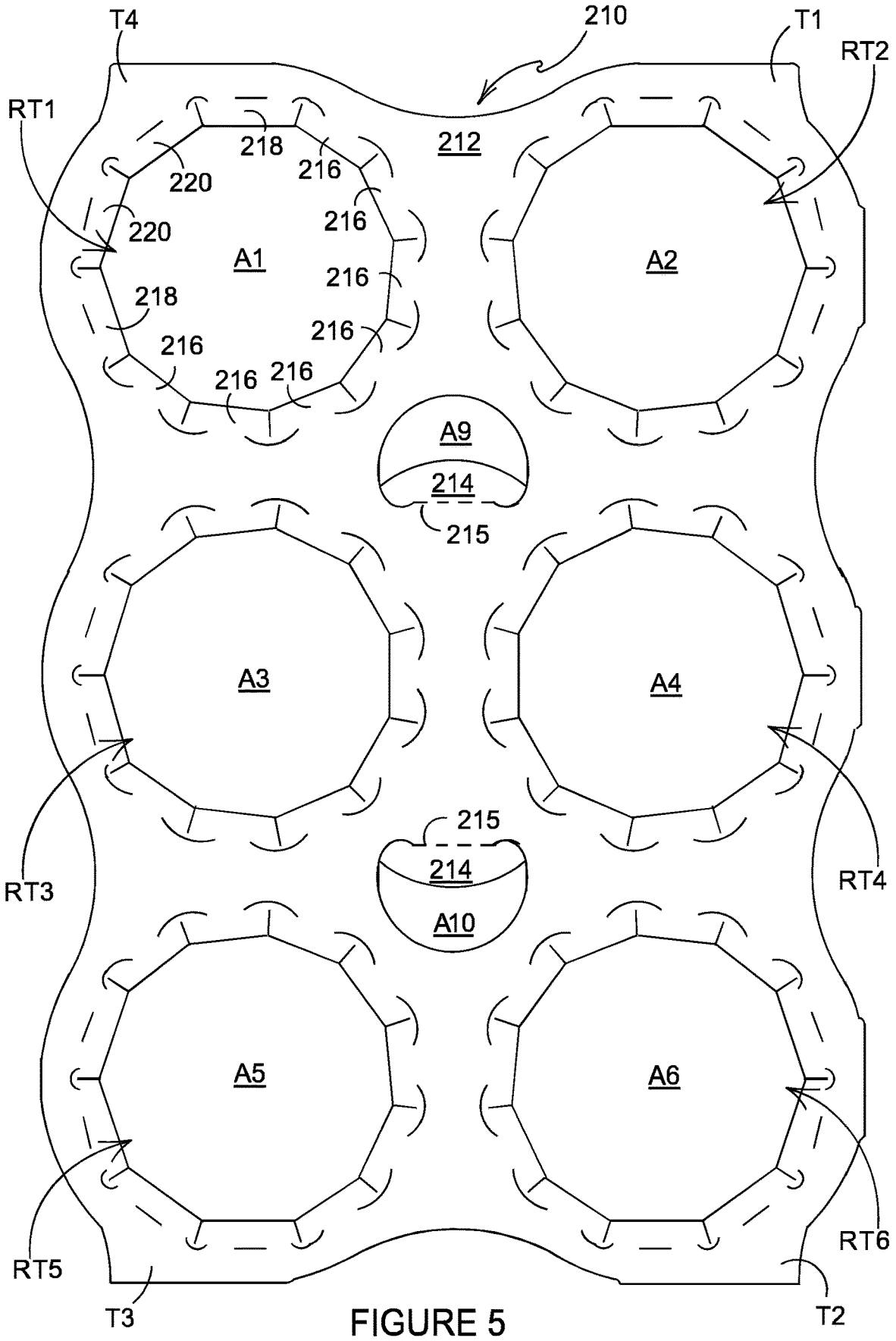
FIG. 5 is a plan view from above of a blank for forming an article carrier according to a third embodiment.
Figure 7:
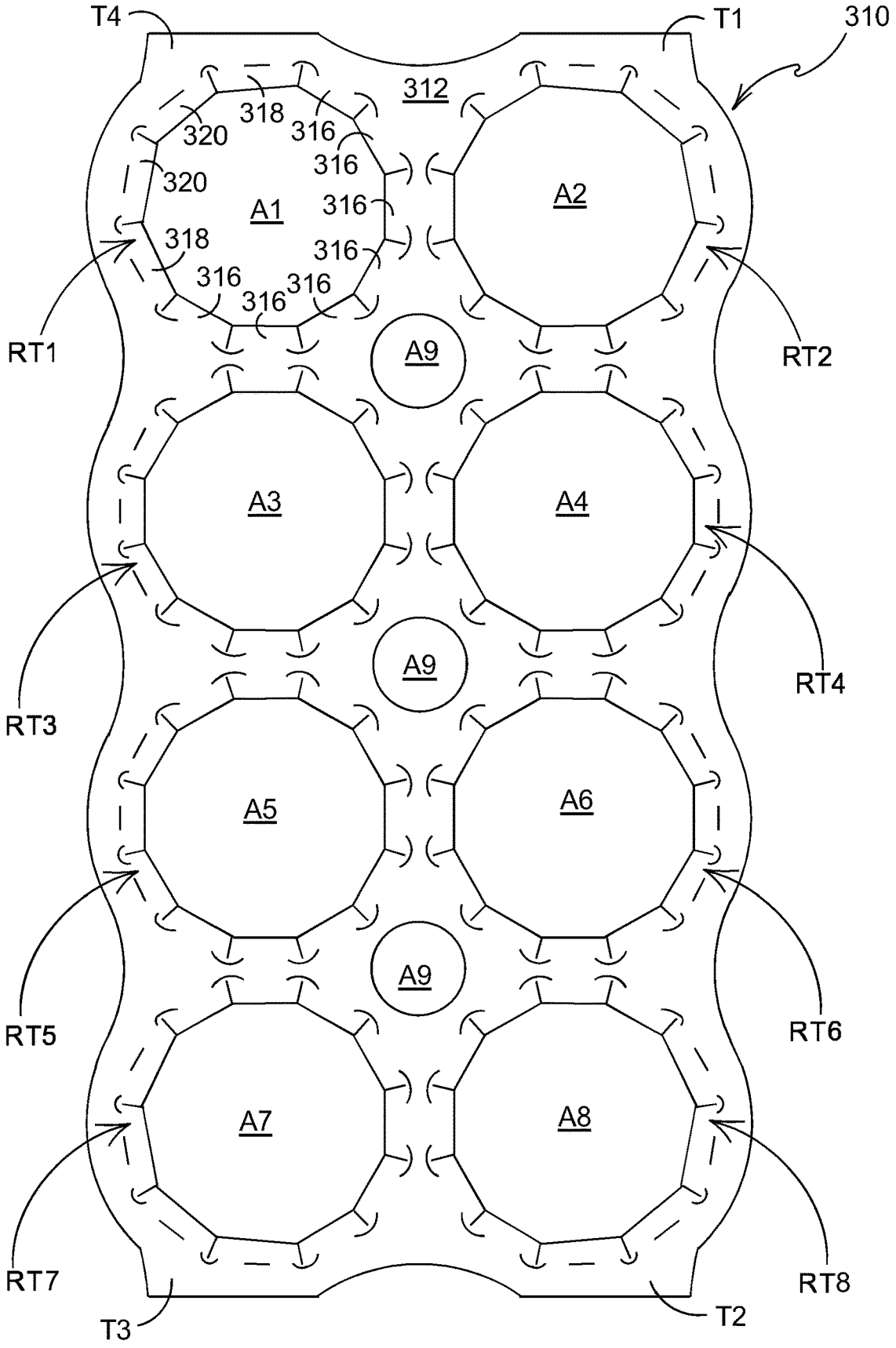
FIG. 7 is a plan view from above of a blank for forming an article carrier according to a fourth embodiment.

Referring to FIG. 1, there is shown a plan view of a blank 10 capable of forming a carton or carrier 90, as shown in FIG. 2, for containing and carrying a group of primary products such as, but not limited to, bottles or cans, hereinafter referred to as articles B, as shown in FIG. 2. The blank 10 forms a secondary package for packaging at least one primary product container or package. Alternative blanks 110, 210, 310 are shown in FIGS. 4, 5 and 7.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blanks 10,110, 210, 310 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blanks 10,110 are configured to form a carton or carrier 90 for packaging an exemplary arrangement of exemplary articles B. In the embodiment illustrated in FIGS. 1 and 4, the arrangement is a 2×2 matrix or array; in the illustrated embodiment two rows of two articles are provided, and the articles B are beverage cans. In the embodiment illustrated in FIG. 5, the arrangement is a 3×2 matrix or array; in the illustrated embodiment three rows of two articles are provided, and the articles B are beverage cans. In the embodiment illustrated in FIG. 7, the arrangement is a 4×2 matrix or array; in the illustrated embodiment four rows of two articles are provided, and the articles B are beverage cans. Alternatively, the blanks 10, 110, 210, 310 can be configured to form a carrier for packaging other types, number and size of articles and/or for packaging articles in a different arrangement or configuration.

Referring to FIG. 1, the blank 10 comprises a main panel 12 for forming a top wall or engaging panel of a carrier 90 (see FIG. 2).

The main panel 12 includes at least one article retention structure RT1, RT2, RT3, RT4. In the embodiment of FIG. 1 the main panel comprises a plurality of article retention structures RT1, RT2, RT3, RT4, specifically four article retention structures RT1, RT2, RT3, RT4 arranged in 2×2 matrix or array.

Each of the article retention structures RT1, RT2, RT3, RT4 is substantially similar in construction and will therefore be described in detail with reference to the first article retention structure RT1.

The first article retention structure RT1 comprises an aperture A1. The first aperture A1 is an eleven-sided polygon or hendecagon. In other embodiments, other polygonal shapes, circular shapes, or scalloped shapes may be employed.

A plurality of article engaging tabs 16, 18, 20 are arranged about the periphery of the aperture A1. Each tab 16, 18, 20 is hinged to the main panel 12.

Each tab 16, 18, 20 is separated from its adjacent neighbors by a linear cutline 11. In this way each tab 16, 18, 20 comprises a first side edge 19 and a second side edge 21. Each tab 16, 18, 20 comprises a free end edge 23 opposing a hinged edge. The free end edges 23 form engaging edges for retaining an article B, or at least a portion thereof, within the aperture A1. The free end edges 23 each defines a side of the polygonal shape of the first aperture A1. Each of the linear cutlines 11, which define the side edges of the tabs 16, 18, 20, extend from a vertex or corner of the polygonal shape of the first aperture A1. The linear cutlines 11 may be substantially radially arranged with respect to a notional circle that passes through each of the vertices of the polygonal shape of the first aperture A1. The linear cutlines 11 comprise a first proximal end that intersects with a vertex or corner of the polygonal shape of the first aperture A1. The linear cutlines 11 comprise a second distal end.

The plurality of article engaging tabs 16, 18, 20 comprises a series or set of first article engaging tabs 16, a series or set of second article engaging tabs 18, and a series or set of third article engaging tabs 20.

The set of first article engaging tabs 16 are located on the main panel 12 in a region in which the article engaging tabs are subject to the greatest stress or deformation when an article B is received in the first article retention structure RT1.

A first arcuate cutline 26 is disposed proximate each of the linear cut lines 11 defining the side edges of the first article engaging tabs 16. Each first arcuate cutline 26 is spaced apart from the second distal end of the linear cutlines 11 so as to define a connecting portion 28 or "nick" between a pair of adjacent first article engaging tabs 16.

The set of third article engaging tabs 20 are located on the main panel 12 in a region in which the article engaging tabs are subject to the least stress or deformation when an article B is received in the first article retention structure RT1.

A third arcuate cutline 22 is disposed proximate each of the linear cut lines 11 defining the side edges of the third article engaging tabs 20. Each third arcuate cutline 22 is spaced apart from the second distal end of the linear cutlines 11 so as to define a connecting portion 28 or "nick" between a pair of adjacent third article engaging tabs 20. Those connecting portions 28 or "nicks" are provided for maintaining a connection between a pair of adjacent tabs 16, 18, 20 even after an article B is inserted into the aperture A1, A2, A3, A4, see FIGS. 3A, 3B. The connecting portions 28 connect the respective tab 16, 18, 20 with the next adjacent tab 16, 18, 20, thereby preventing or inhibiting the respective tab 16, 18, 20 from wobbling or rotating about the axis denoted by notional line X-X' (see FIG. 1) or at least mitigating against such wobbling or rotation.

The set of second article engaging tabs 18 are located on the main panel 12 so as to provide a transition between one of the first article engaging tabs 16 and one of the third article engaging tabs 20.

A second arcuate cutline 24, 25 is disposed proximate a cut line 11 separating each of the second article engaging tabs 18 from an adjacent third article engaging tab 20.

Each second arcuate cutline 24, 25 is spaced apart from the second distal end of the linear cutlines 11 so as to define a connecting portion 28 or "nick" between a respective one of the second article engaging tabs 18 and the third article engaging tab 20 adjacent to it.

Each of the first and third arcuate cutlines 22, 26 is arranged symmetrically about the linear cutline with which it is associated. Each of the second arcuate cutlines 24, 25 is asymmetrically arranged about one of the linear cutlines 11.

The first, second and third arcuate cutlines 26, 24, 25, 22 provide stress relief in the main panel 12 when the first, second and third article engaging tabs 16, 18, 20 are displaced out of the plane of the main panel 12.

The first and third arcuate cutlines 26, 22 are arranged symmetrically about the respective linear cutline 11 with which they are associated. The first arcuate cutlines 26 are larger in dimension than the third arcuate cutlines 22. The first arcuate cutlines 26 comprise a first radius of curvature, the third arcuate cutlines 22 comprise a second radius of curvature; the first radius of curvature is larger than the second radius of curvature.

Each of the second cutlines 24, 25 is arranged asymmetrically about the respective linear cutline 11 with which it is associated. The second cutlines 24, 25 comprise a first portion and a second portion contiguously arranged with each other. The first portion is disposed proximate the second article engaging tab 18 and the second portion is disposed proximate a third article engaging tab 20. The first portion of each of the second cutlines 24, 25 comprises a first radius of curvature, the second portion of each of the second cutlines 24, 25 comprises a second radius of curvature; the first radius of curvature is larger than the second radius of curvature.

The second cutlines 24, 25 may be considered to comprise one half of a first arcuate cutline 26 and one half of a third arcuate cutline 22 contiguously arranged with each other.

The second cutlines 24, 25 form asymmetrical 'C'-shaped cuts, whereas the first and third cutlines 26, 22 form symmetrical 'C'-shaped cuts. The second cutlines 24, 25 are employed at the boundary between a first area of the main panel 12 that is subject to higher stress upon displacement of the first article engaging tabs 16 and a second area of the main panel 12 that is subject to lower stress upon displacement of the third article engaging tabs 20. The higher stress area of the main panel 12 occurs where the first tabs 16 are located as these first tabs 16 undergo higher bending stress, when an article B is inserted into the respective aperture A1, A2, A3, A4, than the third tabs 20 disposed in the lower stress area of the main panel 12.

Each of the third article engaging tabs 20 is defined in part by a second linear cutline 17 provided in the main panel 12.

Each second linear cutline 17 is disposed between a pair of adjacent arcuate cutlines 26, 24, 25, 22 in a spaced apart relationship with each of the pair of adjacent arcuate cutlines 26, 24, 25, 22. Each of the third article engaging tabs 20 adjacent to one of the second article engaging tabs 18 comprises a second linear cutline 17 disposed between a first arcuate cutline 26 and second arcuate cutlines 24, 25 in a spaced apart relationship with respect to both the first arcuate cutline 26 and the second arcuate cutlines 24, 25. The remaining third article engaging tabs 20 comprise a second linear cutline 17 disposed between a pair of adjacent first arcuate cutlines 26 in a spaced apart relationship with each of the pair of adjacent first arcuate cutlines 26.

The second linear cutline 17 facilitates folding of each of the third article engaging tabs 20 with respect to the main panel 12.

The second linear cutline 17 defines at least in part a straight or linear fold line 17 by which each of the third article engaging tabs 20 is hinged to the main panel 12.

In the illustrated embodiment the first article retention structure RT1 comprises eleven tabs 16, 18, 20 arranged about the periphery of the aperture A1.

Optionally, the plurality of article engaging tabs 16, 18, 20 may vary in dimension according to their location on the main panel 12. The first article engaging tabs 16 may have a first width, the second article engaging tabs 18 may have a second width and the third article engaging tabs 20 may have a third width. The third width may be greater than the second width which in turn may be greater than the first width. In this way the free end edge 23, which forms an engaging edge E1, E2, of the first tabs 16 is smaller in dimension than the free end edge 23 or engaging edge of the second or third tabs 18, 20.

In the illustrated embodiment, the article engaging tabs 16, 18, 20 located in the region of the main panel 12 and subject to the greatest stress or deformation when an article B is received in the article retention structure RT1, RT2, RT3, RT4, are smaller in dimension than the article engaging tabs 16, 18, 20 located in the region of the main panel 12 subject to the least stress or deformation.

The main panel 12 may optionally comprise a handle structure. The handle structure may comprise a first handle aperture A5. The first handle aperture A5 is struck from the main panel 12 and is located in a region disposed centrally between a first pair of article retention structures RT1, RT2 and a second pair of article retention structures RT3, RT4. The first handle aperture A5 may be defined in part by a cushioning tab 14 hinged to the main panel 12 by fold line 15. The first handle aperture A5 may be substantially crescent or "C" shaped.

The main panel 12 may optionally comprise one or more pull tabs T1, T2, T3, T4. The pull tabs T1, T2, T3, T4 may be located substantially at the corners of the main panel 12. The pull tabs T1, T2, T3, T4 may be substantially triangular in shape. The pull tabs T1, T2, T3, T4 may be arranged to extend the main panel 12 beyond the footprint of the group of articles B being packaged; in this way, a user may more readily disengage the carrier 90 from the articles B.

Optionally, the side edges of the main panel 12 may be arranged in a curvilinear or undulating shape. In this way, a first blank 10 may be arranged in a nested arrangement with a second blank 10. The undulating shape provides that the first and second blanks 10 together define a width which is less than twice the maximum width of an individual blank 10. This may have economic and environmental benefit by reducing the amount of substrate required to produce a given number of blanks 10.

The main panel 12 includes at least a paperboard substrate and a tear resistant layer laminated together. It optionally includes an adhesive layer between the paperboard substrate and the tear resistant layer. The material of the paperboard substrate may be selected from any conventional paperboard, for example, ranging in weight upwardly from about 10 pt., preferably from about 11 pt. to about 14 pt. An example of such a substrate is a 12-point SBS board or CNK board manufactured by WestRock Company. Higher weights of paperboard substrate may be used for heavier articles. The paperboard substrate may be at least 14 pt, or at least 20 pt, or at least 24 pt, or at least 28 pt, or at least 32 pt or greater. As a non-limiting example, for carrying 16 ounce cans, the paperboard substrate may be about 28 pt. The paperboard substrate may be a bleached or unbleached board. The paperboard substrate may contain a wet-strength additive. The paperboard may be coated on at least one side, optionally the side opposite the lamination, with a conventional coating selected for compatibility with the printing method and board composition.

The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalyzed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

Turning to the construction of the carrier 90 from the blank 10, the blank 10 may be applied to a group of articles B. The blank 10 is lowered with respect to the group of articles B. Each of the article retention structures RT1, RT2, RT3, RT4 of the blank 10 are aligned with a respective article B in the group. Portions of the articles B pass through the main panel 12. The tabs 16, 18, 20 of each of the article retention structures RT1, RT2, RT3, RT4 are folded out of the plane of the main panel 12 and engage beneath the chime C (which may provide a flange F) of an article B. In this way, the tabs 16, 18, 20 grip or hold the article B and prevent or inhibit the article B from unintentionally separating from the main panel 12. The assembled carton 90 is shown in FIG. 2.

Figure 3A:
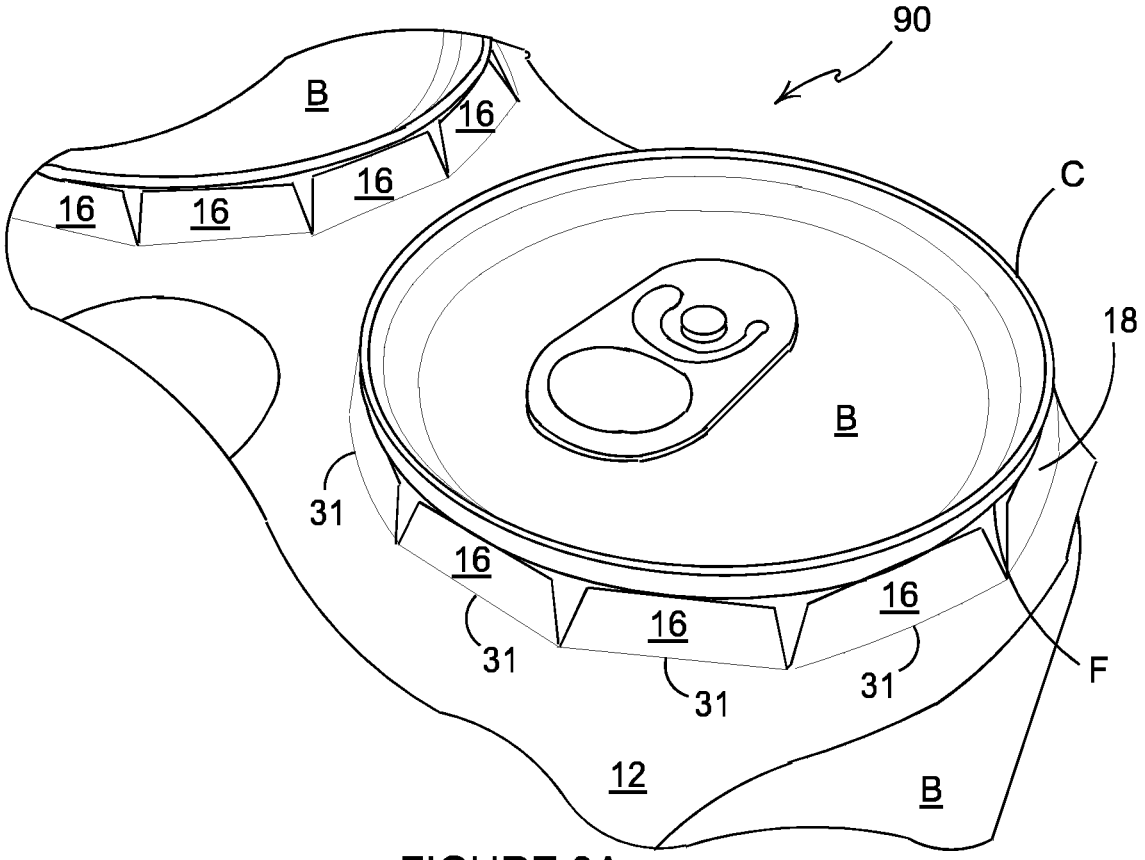
FIGS. 3A and 3B are enlarged views of a portion of the article carrier of FIG. 2.
Figure 3B:
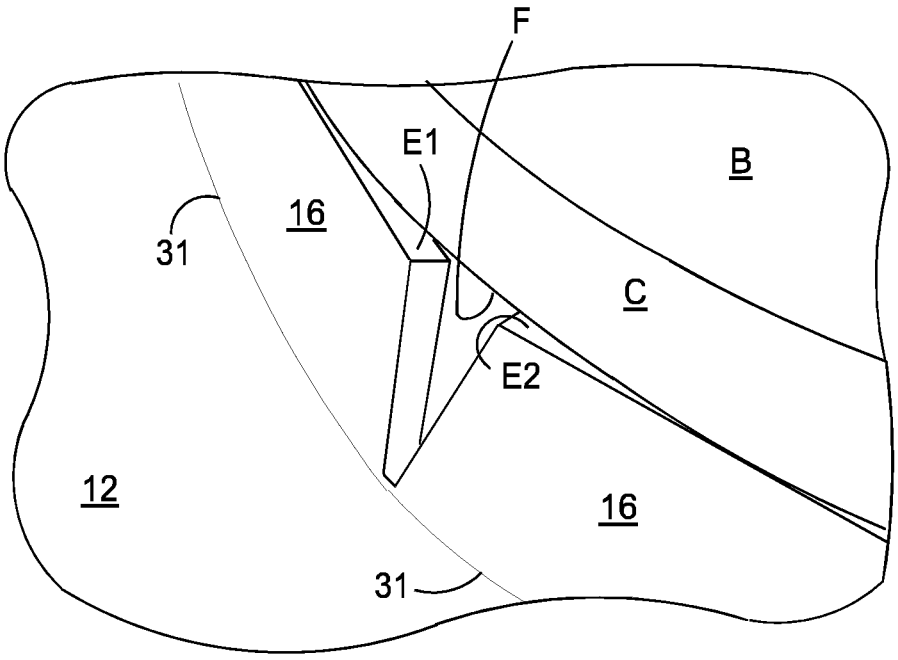

Referring in particular to FIG. 3A and to FIGS. 2 and 3*b*, the blank 10 forms a top engaging carrier 90 comprising a main panel 12 which comprises first and second adjacent apertures A1, A3 arranged side by side each for receiving a portion of an article B. The main panel 12 further comprises an annular series of tabs 16, 18, 20 formed around each of the first and second apertures A1, A3. The tabs 16, 18, 20 of each annular series are connected to the main panel 12 such that the tabs 16, 18, 20 yield out of the plane of the main panel 12, about fold lines 31, when an article B is received in the respective aperture A1, A3 so as to bear against the article B.

Another optional feature of the carrier 90 is that the main panel 12 is defined by a perimeter to which no other part of the carrier 90 is connected. That is to say, the carrier 90 is free of connection to other panels for example, but not limited to, side or end wall panels which extend about the sides of the article group. The perimeter of the main panel 12 is therefore defined in its entirety by free, cut or unhinged edges.

Another optional feature of the carrier 90 is that the main panel 12 is defined by a perimeter including convexly curved edges and concavely curved edges, wherein the radius of curvature of the convexly curved edges is substantially equal to the radius of curvature of the concavely curved edges, thus allowing two similar blanks 10 to be placed in a nested or tessellated arrangement.

Referring now to FIG. 4, there is shown an additional embodiment of the present disclosure. In the second illustrated embodiment like numerals have, where possible, been used to denote like parts, albeit with the addition of the prefix "100" to indicate that these features belong to the second embodiment. The additional embodiment shares many common features with the first embodiment and therefore only the differences from the embodiment illustrated in FIGS. 1 to 3B will be described in detail.

Each of the first article engaging tabs 116 is constructed substantially similarly to those of the embodiment of FIGS. 1 to 3B.

Each of the third article engaging tabs 120 is spaced apart from its adjacent neighbors 120, 118 by a cutaway or recess R1, R2. In this way, each of the third article engaging tabs 120 comprises a first side edge and a second side edge. Each of the third article engaging tabs 120 comprises a free end edge opposing a hinged end edge defined in part by second linear cutline 117. The free end edges form engaging edges for retaining an article B, or at least a portion thereof, within the aperture A1, A2, A3, A4.

Each of the recesses R1, R2 comprises a curvilinear portion. In the illustrated embodiment the recesses R1, R2 comprise a rounded end. That is to say, the curvilinear portion can be defined by a portion of the circumference of a circle. A portion of the recesses R1, R2 may be defined by a segment of a circle. A further portion of the recesses R1, R2 may be defined by a trapezoid; the trapezoid may be an isosceles trapezoid. The trapezoid has convergent side edges. Each of the third article engaging tabs 120 may be hinged to the main panel 112 by a straight fold line defined in part by, or interrupted by, the second linear cutlines 117 which straight fold line is in tangential contact, or intersects, with the rounded end of the adjacent recess R1, R2.

The curvilinear portion or rounded end of the cutaways or recesses R1, R2 may reduce the likelihood of tears propagating in the main panel 112 from the cutaway.

The curvilinear end of each cutaway R1, R2 may be defined in part by a circle having a radius of curvature. In one embodiment, the radius of curvature of the rounded end of each cutaway R1, R2 may be equal to or more than 1/16" (1.6 mm).

Each of the second article engaging tabs 118 is spaced apart from its adjacent neighboring third article engaging tab 120 by a cutaway or recess R1, R2. Each of the second article engaging tabs 118 is spaced apart from its adjacent neighboring first article engaging tab 116 by a linear cutline 111; a first arcuate cutline 126 is provided proximate the linear cutline 111. The first arcuate cutline 126 is spaced apart from the linear cutline 111 so as to define, at least in part, a connecting portion or 'nick' between each second article engaging tabs 118 and said adjacent neighboring first article engaging tab 116.

Referring now to FIGS. 5 to 10, there are shown additional embodiments of the present disclosure. In the third and fourth illustrated embodiments like numerals have, where possible, been used to denote like parts, albeit with the addition of the prefix "200", "300" to indicate that these features belong to the third and fourth embodiment respectively. The additional embodiments share many common features with the first embodiment and therefore only the differences from the embodiment illustrated in FIGS. 1 to 3 will be described in detail.

Figure 6:
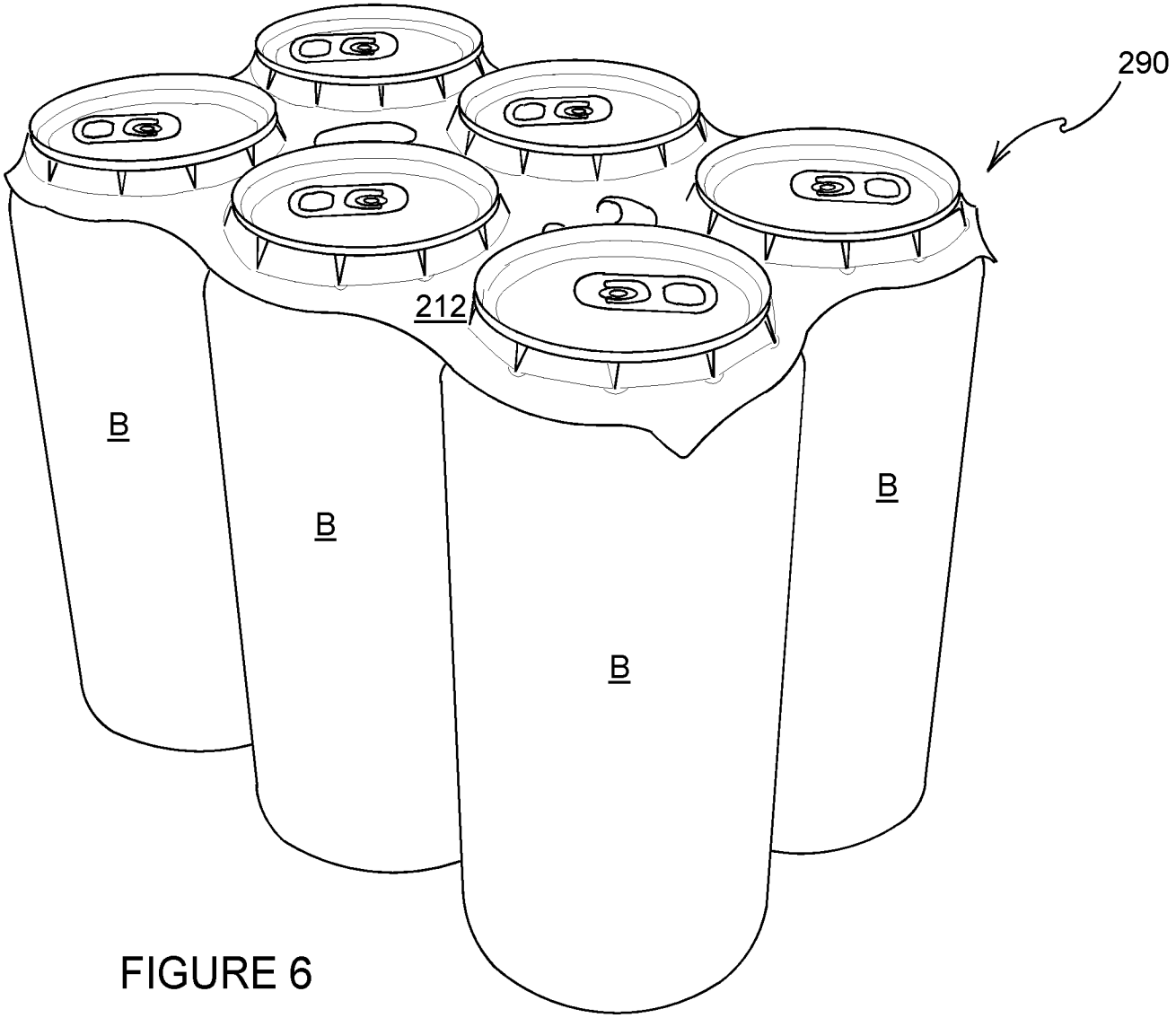
FIG. 6 is a perspective view from above of an article carrier formed from the blank of FIG. 5.

Referring to FIGS. 5 and 6, there is shown a blank 210 comprising a main panel 212 for forming a top wall or engaging panel of a carrier 290.

The main panel 212 comprises a plurality of article retention structures RT1, RT2, RT3, RT4, RT5, RT6; specifically, six article retention structures RT1, RT2, RT3, RT4, RT5, RT6 arranged in 2×3 matrix or array.

Each of the article retention structures RT1, RT2, RT3, RT4, RT5, RT6 comprises an aperture A1, A2, A3, A4, A5, A6.

Each of the article retention structures RT1, RT2, RT3, RT4, RT5, RT6 is substantially similar in construction to the first article retention structure RT1 of the embodiment of FIG. 1.

The main panel 212 comprises a handle structure. The handle structure comprises a first handle aperture A9 and a second handle aperture A10. The first handle aperture A9 is struck from the main panel 212 and is located in a region disposed centrally between a first pair of article retention structures RT1, RT2 and a second pair of article retention structures RT3, RT4. The first handle aperture A9 may be defined in part by a cushioning tab 214 hinged to the main panel 212 by fold line 215. The first handle aperture A9 may be substantially crescent or "C" shaped. The second handle aperture A10 is struck from the main panel 212 and is located in a region disposed centrally between the second pair of article retention structures RT3, RT4 and a third pair of article retention structures RT5, RT6. The second handle aperture A10 may be defined in part by a cushioning tab 214 hinged to the main panel 212 by fold line 215. The second handle aperture A10 may be substantially crescent or "C" shaped.

Figure 8:
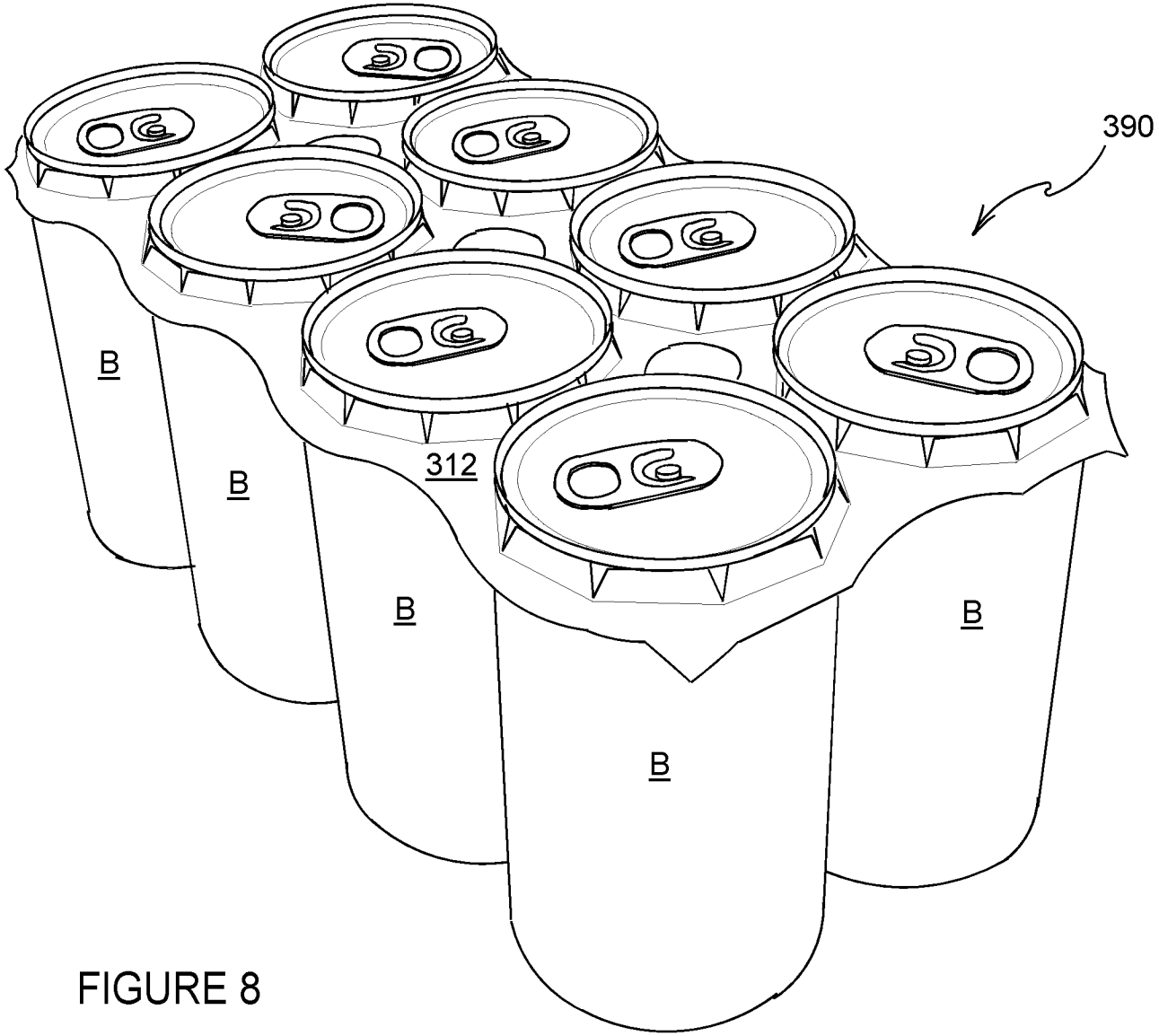
FIG. 8 is a perspective view from above of an article carrier formed from the blank of FIG. 7.
Figure 9:
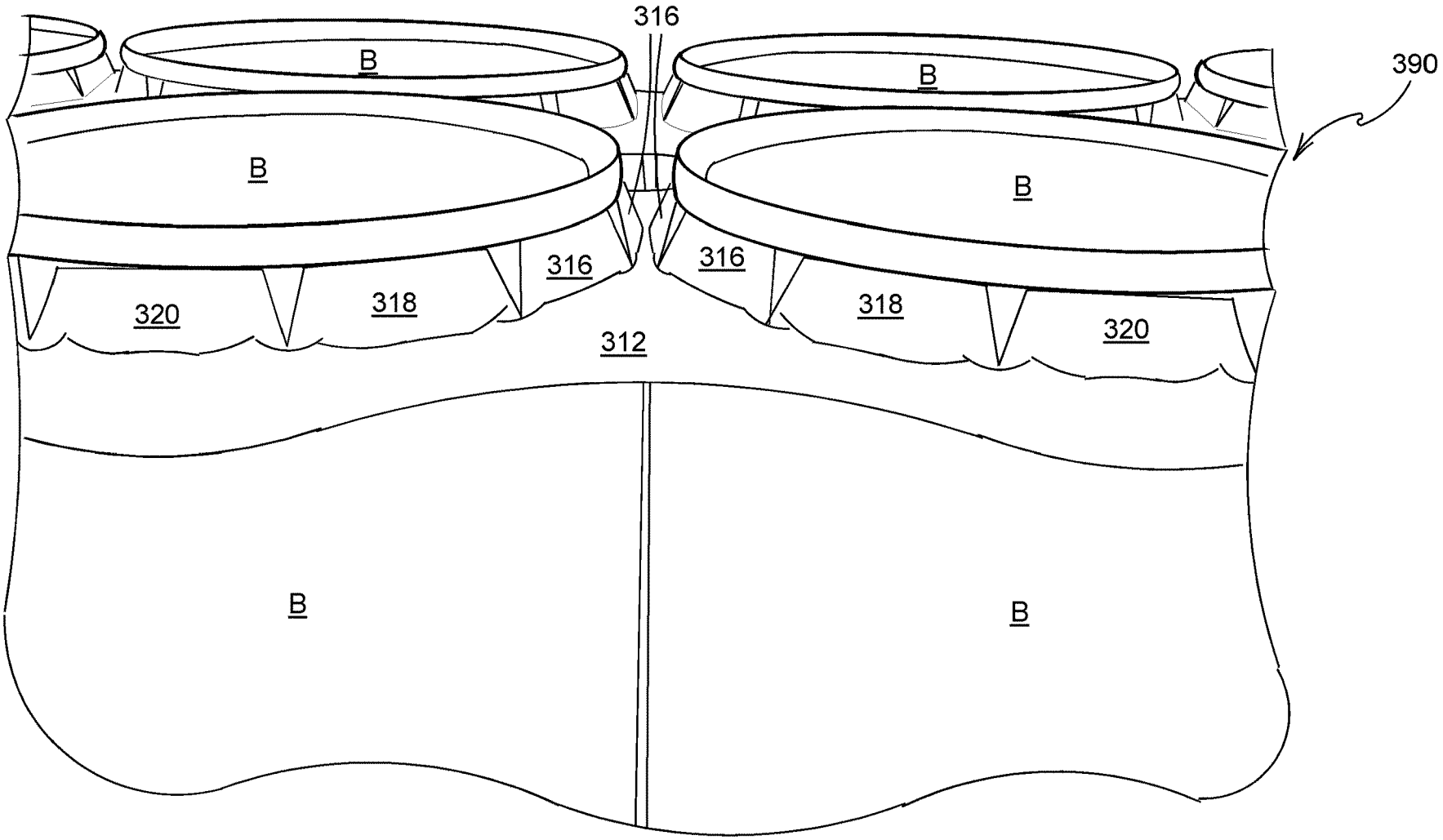
FIG. 9 is a close-up view of a portion of the article carrier of FIG. 8.
Figure 10:
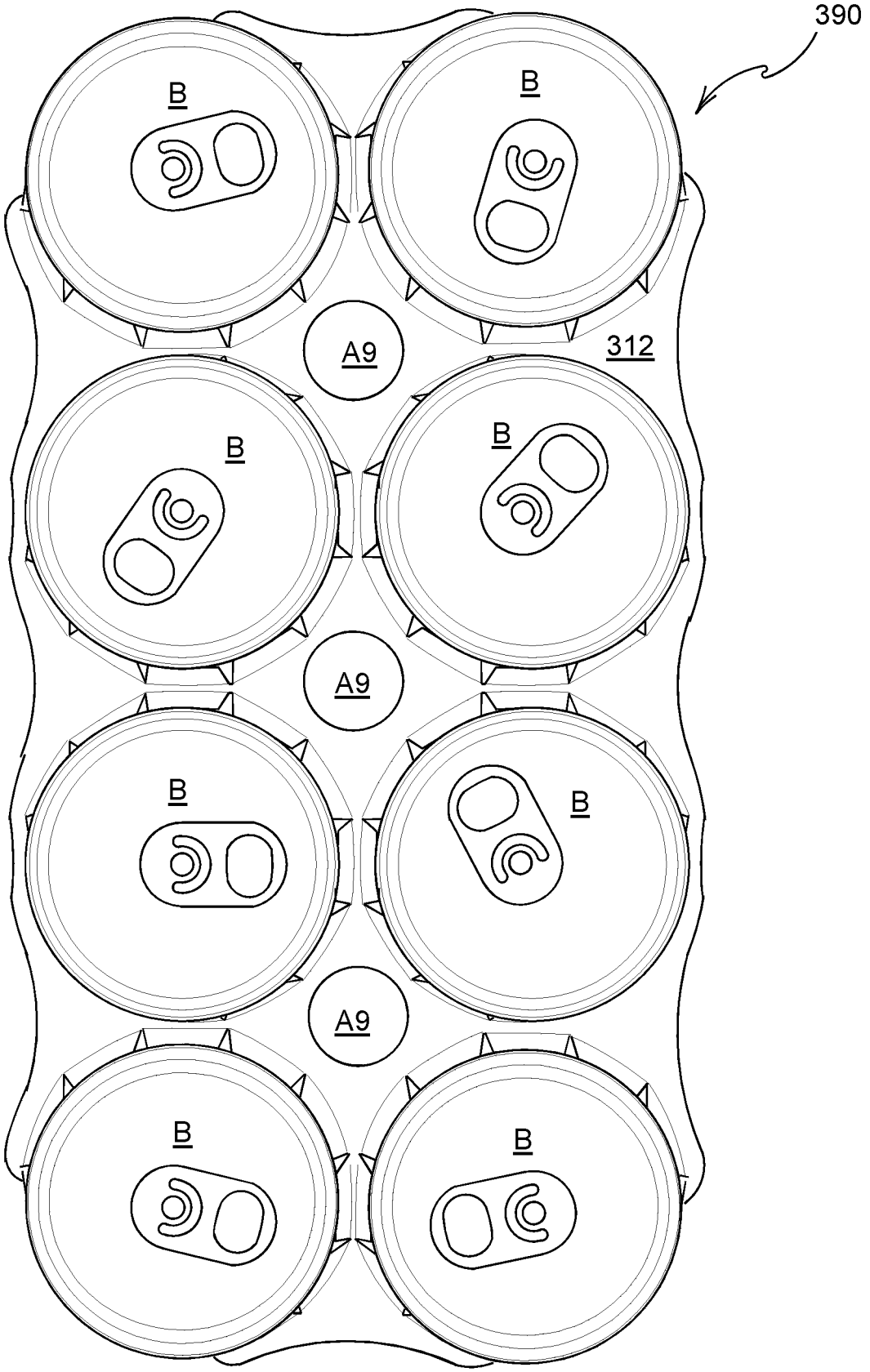
FIG. 10 is a plan view from above of the article carrier formed from the blank of FIG. 7.

Referring to FIGS. 8 to 10, there is shown a blank 310 comprising a main panel 312 for forming a top wall or engaging panel of a carrier 390.

The main panel 312 comprises a plurality of article retention structures RT1, RT2, RT3, RT4, RT5, RT6, RT7, RT8; specifically, eight article retention structures RT1, RT2, RT3, RT4, RT5, RT6, RT7, RT8 arranged in 2×4 matrix or array.

Each of the article retention structures RT1, RT2, RT3, RT4, RT5, RT6, RT7, RT8 comprises an aperture A1, A2, A3, A4, A5, A6, A7, A8.

Each of the article retention structures RT1, RT2, RT3, RT4, RT5, RT6, RT7, RT8 is substantially similar in construction to the first article retention structure RT1 of the embodiment of FIG. 1.

The main panel 312 comprises a handle structure. The handle structure comprises three handle apertures A9. A first handle aperture A9 is struck from the main panel 312 and is located in a region disposed centrally between a first pair of article retention structures RT1, RT2 and a second pair of article retention structures RT3, RT4. A second handle aperture A9 is struck from the main panel 312 and is located in a region disposed centrally between the second pair of article retention structures RT3, RT4 and a third pair of article retention structures RT5, RT6. A third handle aperture A9 is struck from the main panel 312 and is located in a region disposed centrally between the third pair of article retention structures RT5, RT6 and a fourth pair of article retention structures RT7, RT8. The handle apertures A9 may be substantially circular in shape.

Referring now to the embodiment of FIG. 5, the article retention structures RT3, RT4 comprise more first article engaging tabs 216 than the article retention structures RT1, RT2, RT5, RT6 which are disposed in the corners of the main panel 212. In the illustrated embodiment the article retention structures RT3, RT4 comprise two second article engaging tabs 218 disposed adjacent to one another; in the article retention structures RT3, RT4 the third article engaging tabs 220 are omitted. This reflects the fact that more of the tabs of the article retention structures RT3, RT4 are disposed in high stress regions of the main panel 212 than the corner most retention structures RT1, RT2, RT5, RT6.

Referring now to the embodiment of FIG. 7, the article retention structures RT3, RT4, RT5, RT6 comprise more first article engaging tabs 316 than the article retention structures RT1, RT2, RT7, RT8 which are disposed in the corners of the main panel 312. In the illustrated embodiment the article retention structures RT3, RT4, RT5, RT6 comprise two second article engaging tabs 318 disposed on opposing side of a single third article engaging tabs 320.

In this way it will be recognized that the proportion of the article engaging tabs of each type, first, second or third may be adjusted as desired in accordance with the stresses placed upon the carrier when loaded with articles.

Part 2—Strength Testing

Certain embodiments of the carriers were tested to evaluate their ability to securely hold articles.

Carriers of the 2×2 type were loaded with standard 16-ounce aluminum cans, then stored overnight in a cold room at a temperature of 5.0 C±0.3 C and a relative humidity of 30%±3%.

Figure 11:
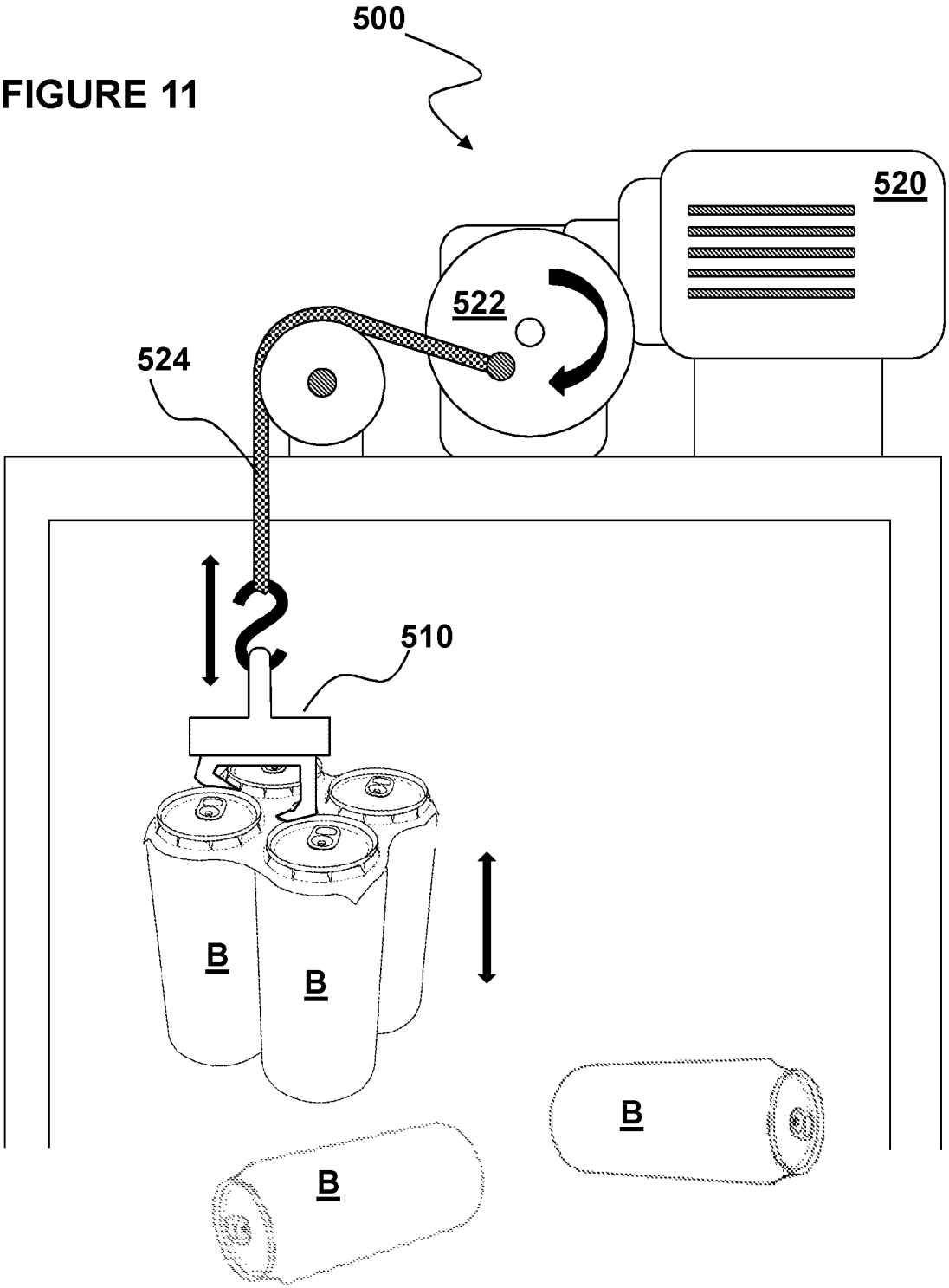
FIG. 11 is a simplified view of an apparatus for testing article carriers.

Upon removal from the cold room, the loaded carriers were placed for two hours in a humidity room at a temperature of 40 C±1.5 C and a relative humidity of 90%±3%. These conditions are intended to simulate the environment around the package when it is removed from refrigeration into a humid environment. Once removed from the humidity room, each carrier was suspended by the handle aperture (e.g. A5) from a hook 510 provided on the device 500 of FIG. 11. The hook is intended to simulate a customer holding the carrier by placing his thumb through aperture A5 and a finger around the edge of the carrier. A motor 520 turns wheel 522 to which chain 524 is attached off-center. The eccentric attachment of the chain to wheel 522 causes hook 510 to move up and down with a two-inch amplitude, at approximately 90 times per minute. The number of cycles is counted until at least one article B comes loose from the carrier. This movement is intended to simulate the stresses imposed on the carrier when a customer carries it down a flight of stairs. This test was repeated four to six times for each test condition.

The retaining apertures of the HI-CONE® carrier are approximately rectangular openings that are stretched to accommodate the cans. The paperboard carriers tested here used either the design shown in FIG. 12A (for condition X2) or the design shown in FIG. 12B (for conditions X3-X9). The materials used are shown in cross-section in FIGS. 13A-13F). The results are shown in Table 1. The lowest three tests were averaged ("Low Average"), and the results in Table 1 are listed (approximately in order) from least to greatest number of cycles endured by the samples. If the carrier endured 100 test cycles, the test was concluded without further cycles.

Condition X1, a 15 mil thick HI-CONE® low density polyethylene (LDPE) can collar (marketed by Illinois Tool Works), and including no paperboard substrate, lasted two test cycles. The material used for condition X1 is represented by the structure shown in in cross section in FIG. 13A.

Condition X2, NATRALOCK® paperboard (marketed by WestRock Company) is a 28 pt CNK (0.028" coated natural kraft) paperboard laminated with a 1.4 mil tear-resistant (TR) polyethylene terephthalate (PET) film. The retaining apertures used in this condition were of the style depicted in FIG. 12A. The material structure is shown in cross section in FIG. 13B. (A tie layer exists between the paperboard and PET.) Condition X2 lasted only about one test cycle.

Figure 12A:
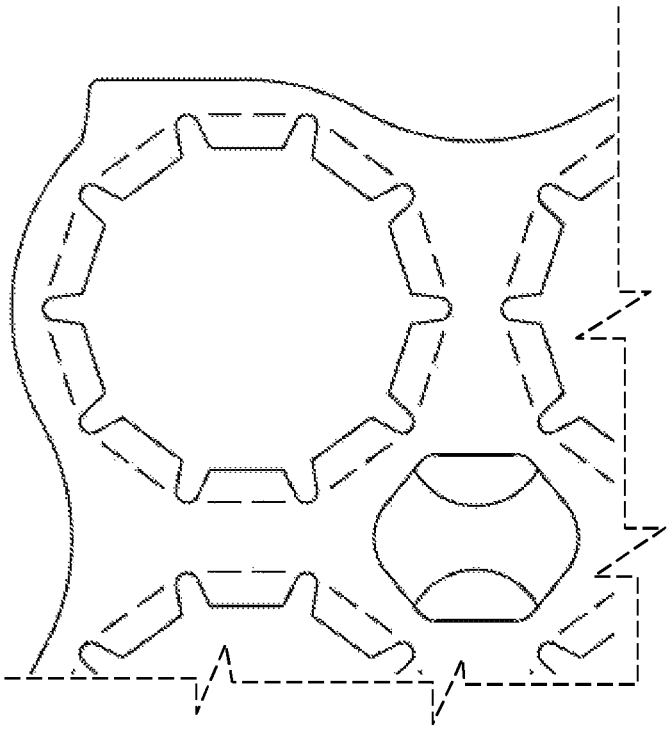
FIGS. 12A and 12B are plan views from above of a portion of blanks used for testing.
Figure 12B:
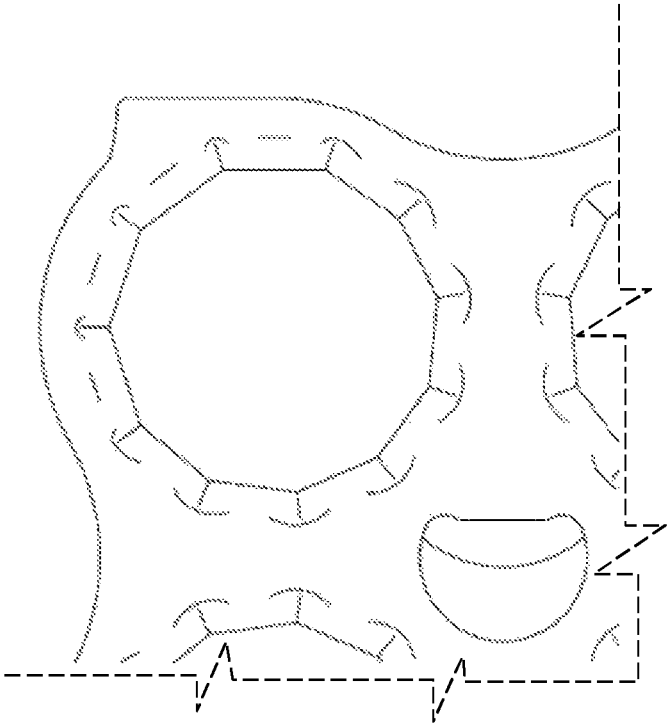

Condition X3 used the same material (FIG. 13B) as X2, but with the improved retaining structure of FIG. 12B. Condition X3 lasted 21 test cycles, compared to only one cycle for Condition X2. The retaining structure (FIG. 12B instead of FIG. 12A) is the only difference between the X2 and X3 conditions, and thus the retaining structure of FIG. 12B appears to greatly improve the performance of the carrier.

The remaining conditions, Conditions X4-X9 all used the improved retaining structure of FIG. 12B. Materials are depicted by the cross sections shown in FIGS. 13C-13F, all based on a 27 pt CNK (0.027" coated natural kraft) paperboard that contains a wet strength additive. This material is marketed by WestRock Company as CARRIERKOTE® paperboard. A 2.0 mil tear-resistant PET film was laminated onto the CARRIERKOTE. A tie layer exists between the paperboard and the PET film.

Figure 13A:
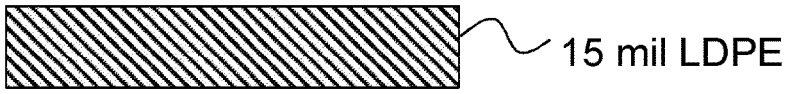
FIGS. 13A-13F show cross sections of several materials for making the blanks.
Figure 13B:
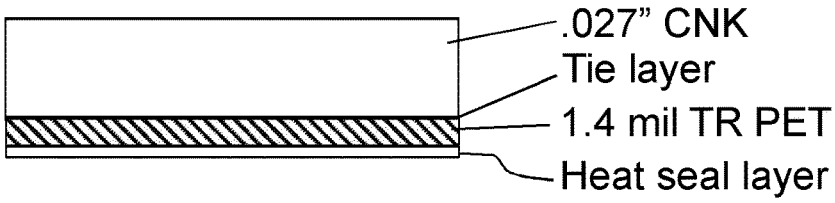
Figure 13C:
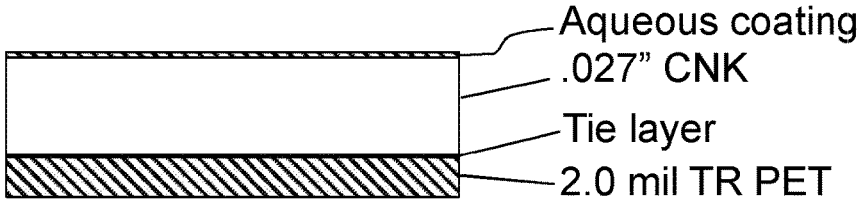

Condition X4 used the structure of FIG. 13C, with an aqueous water-resistant coating on the surface opposite from the 2 mil PET film. Condition X4 lasted 25 test cycles, which was not as good as conditions X5/X6 without the added aqueous coating.

Figure 13D:
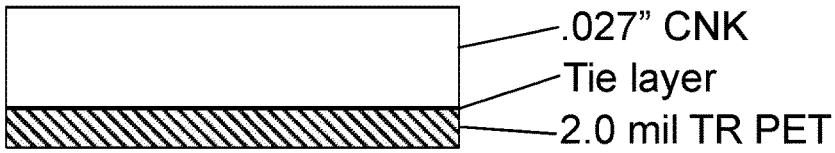

Conditions X5 and X6 were identical, and used the structure of FIG. 13D. Conditions X5 and X6 lasted 33 test cycles, which is a modest improvement over the 25 test cycles of condition X4.

Figure 13E:
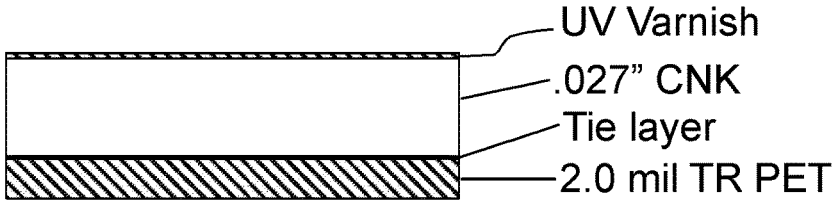

Condition X7 was similar to X5 and X6, excepting that a UV-curable varnish was applied to the surface of the paperboard opposite from the PET film, as depicted in FIG. 13E. This gave a further improvement with the carrier lasting about 43 test cycles.

Figure 13F:
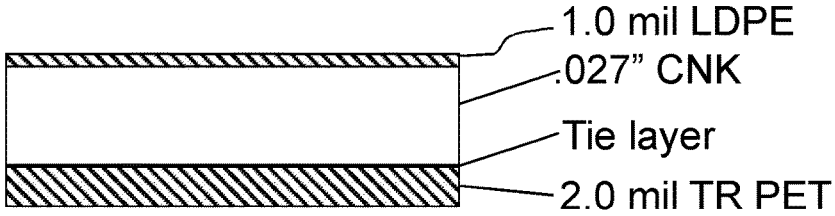

Conditions X8 and X9 were identical, and similar to X7, except that a one mil LDPE layer was applied to the surface of the paperboard opposite from the 2 mil PET film, as depicted on FIG. 13F. Conditions X8 and X9 gave markedly better endurance, lasting at least 100 test cycles.

The carrier blanks used in the tests of Table 1 were cut in the lab using a plotter-type cutter with the knife cut being made from the PET side of the blank. For cutting in a production setting, the carrier blanks would likely be die-cut, probably from the PET side of the blank. For die cutting, the rules (knives) that make the cut may be either a dual bevel rule D1 as shown in FIG. 14A or single bevel rule D2 as shown in FIG. 14B.

If the die cutting is done from the PET side of the blank, a dual bevel rule D1 as shown in FIG. 14A may result in the PET layer P being slightly rounded or slightly recessed with respect to the overall thickness of the teeth, for example teeth 16A, 20A in FIG. 14C.

If the die cutting is done from the PET side of the blank, a single bevel rule D2 as shown in FIG. 14B may result in the PET layer P being more flush or giving a sharper poly edge with respect to the overall thickness of the teeth, for example teeth 16B, 20B in FIG. 14D.

When a can B is inserted into the carrier cut with a dual bevel rule, as shown in FIG. 14C, the PET edge of the teeth 16A, 20A may not engage the flange F as closely as the PET edge of teeth 16B, 20B cut with a single bevel rule, as shown in FIG. 14D. For this reason, it may be advantageous to use a single-bevel rule D2 to die-cut the carrier blank as shown in FIG. 14B.

FIGS. 14C and 14D also show a difference between the teeth 16A,16B toward the center of the carrier, and the teeth 16B, 20B toward the perimeter of the carrier. The perimeter teeth 20A, 20B may bend at an angle 61 with respect to the carrier perimeter material. The more center teeth 16A, 16B may bend at an angle 62 with respect to the carrier interior. Since the carrier interior is relative taut between adjacent cans B, while the carrier perimeter is free to lie against the shoulder of cans B, the angle 62 may be greater than the angle 61, giving rise to higher shear stresses in center teeth 16 compared with perimeter teeth 20. The particular designs of the center teeth 16, as described earlier, help alleviate the stresses that might otherwise tend to delaminate center teeth 16.

Figure 15:
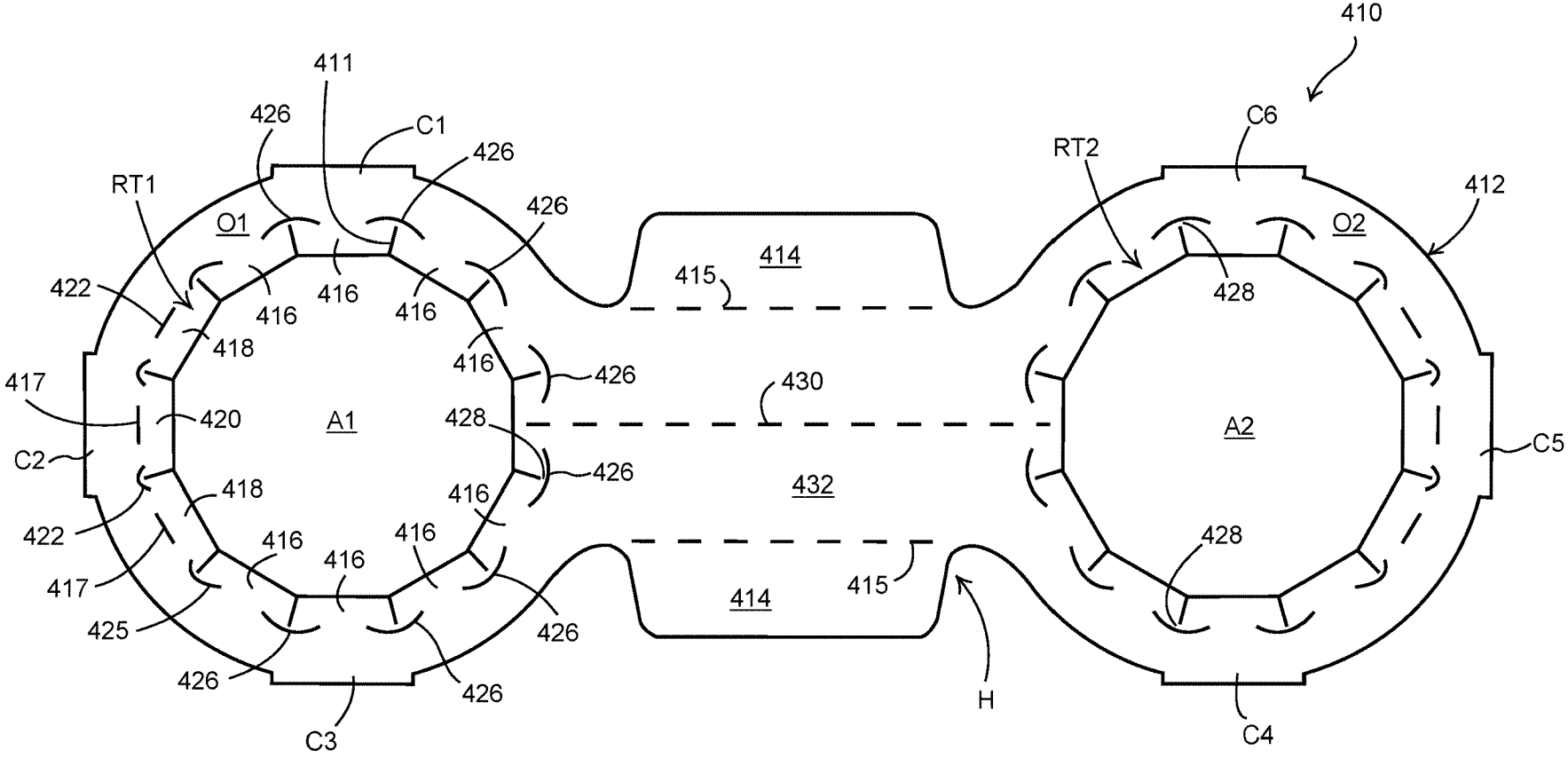
FIG. 15 is a plan view from above of a blank for forming a carton according to the last embodiment.
Figure 16:
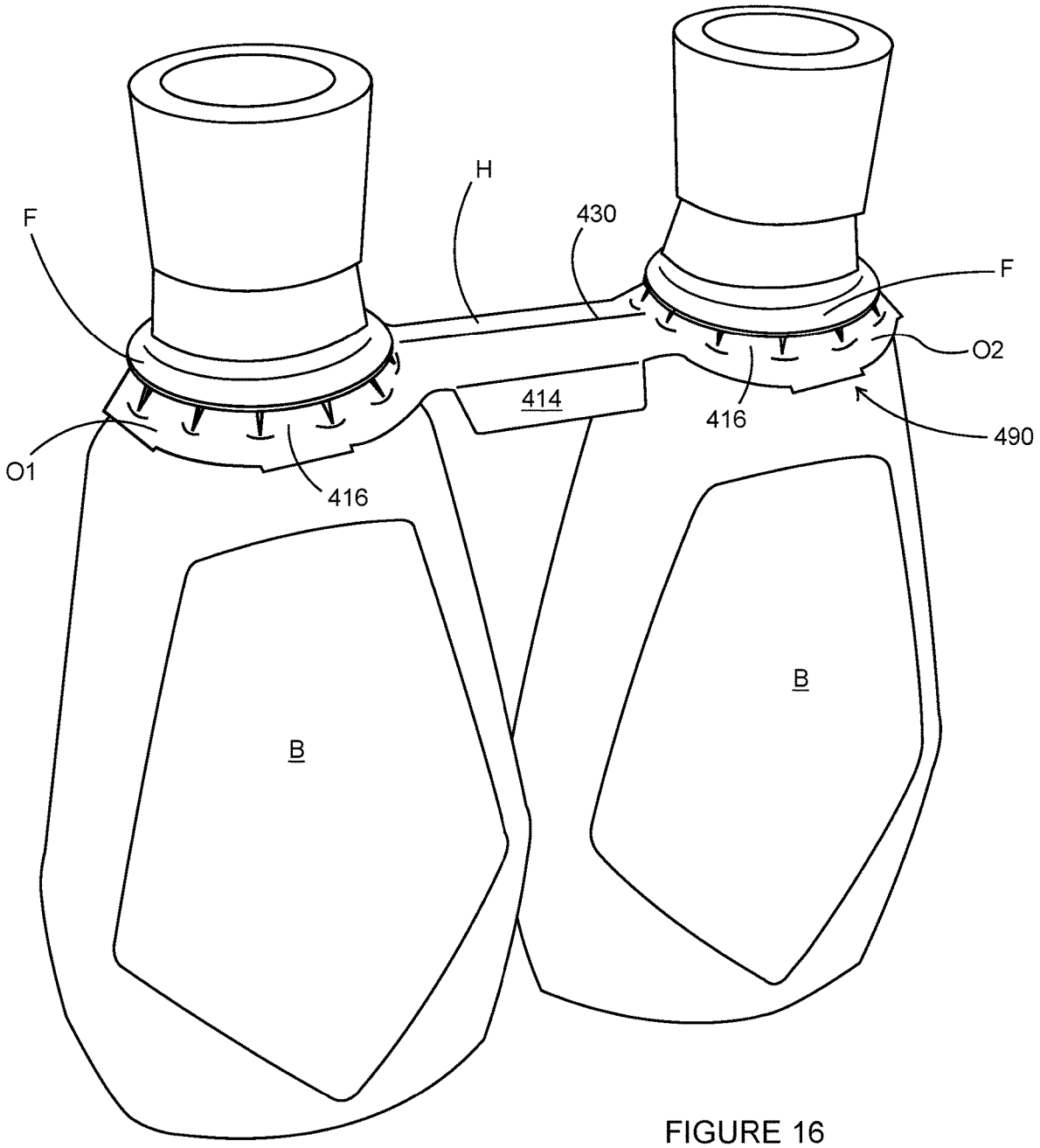
FIG. 16 is a perspective view from above of a carton formed from the blank of FIG. 15.

Referring to FIG. 15, there is shown a plan view of a blank 410 capable of forming a carton or carrier 490, as shown in FIG. 16, for containing and carrying a group of primary products such as, but not limited to, necked or capped containers, which hereinafter are referred to as articles B, as shown in FIG. 16. The blank 410 forms a secondary package for packaging at least two articles B.

In the embodiment, detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blank 410 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognized that one or other numbers of blanks may be employed, where suitable, for example, to provide the carrier structure described in more detail below.

The packaging structure or carrier described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

In the illustrated embodiments, the blank 410 is configured to form a carton or carrier 490 for packaging an exemplary arrangement of exemplary articles B. In the embodiment illustrated in FIGS. 15 and 16, the arrangement is a 1×2 matrix or array, and the articles B are mouth wash bottles. Alternatively, the blank 410 can be configured to form a carrier for packaging other types, number and size of articles and/or for packaging articles in a different arrangement or configuration.

Referring to FIG. 15, the blank 410 comprises a main panel 412 for forming a top wall or engaging panel of a carrier 90 (see FIG. 16).

The main panel 12 includes at least two engaging rings O1, O2 having article retention structures RT1, RT2 respectively. The two engaging rings O1, O2 are interconnected by a bridging member H which provided a carrying handle structure for lifting the package of the two articles B when the engaging rings O1, O2 are engaged with the respective articles B.

The handle structure H comprises a handle panel 432 extending between the engaging rings O1, O2 and a pair of cushioning flaps 414, 414 which are hingedly connected to the handle panel 432 by first and second hinged connections such as fold lines 415, 415 respectively.

Those cushioning flaps 415 are folded down about their respective fold lines 415 to provide hand comfort when the handle structure H is grasped by a user. The handle panel 432 is provided with a center fold line 430 to allow the handle panel 432 to be folded therealong to some extent such that the structural rigidity of the handle structure H is increased.

Each engaging ring O1, O2 is provided with three connecting tabs C1, C2, C3, C4, C5, C^. Those connecting tabs C1 through C6 each provide a convenient location for placing one or more connecting necks so that two or more similar blanks may be connected together for manufacturing purpose.

Each of the article retention structures RT1, RT2 is substantially similar in construction and will therefore be described in detail with reference to the first article retention structure RT1.

The first article retention structure RT1 comprises an aperture A1. The first aperture A1 is a twelve-sided polygon or dodecagon. In other embodiments, other polygonal shapes may be employed.

A plurality of article engaging tabs 416, 418, 420 are arranged about the periphery of the aperture A1. Each tab 416, 418, 420 is hinged to the respective engaging ring of the main panel 412.

Each tab 416, 418, 420 is separated from its adjacent neighbors by a linear (or radial) cutline 411. In this way, each tab 416, 418, 420 comprises a first side edge and a second side edge.

Each tab 416, 418, 420 comprises a free end edge opposing a hinged edge. The free end edges form engaging edges for retaining an article B, or at least a portion thereof, within the aperture A1. The free end edges each defines a side of the polygonal shape of the first aperture A1. Each of the linear cutlines 411, which define the side edges of the tabs 416, 418, 420, extend from a vertex or corner of the polygonal shape of the first aperture A1. The linear cutlines 411 may be substantially radially arranged with respect to a notional circle that passes through each of the vertices of the polygonal shape of the first aperture A1. The linear cutlines 411 comprise a first proximal end that intersects with a vertex or corner of the polygonal shape of the first aperture A1. The linear cutlines 411 comprise a second distal end.

The plurality of article engaging tabs 416, 418, 420 comprises a series or set of first article engaging tabs 416 and a series or set of second article engaging tabs 418, 420.

The set of first article engaging tabs 416 are located on the main panel 412 in a region in which the article engaging tabs are subject to the greatest stress or deformation when an article B is received in the first article retention structure RT1.

A first arcuate (or circumferential) cutline 426 is disposed proximate each of the linear cut lines 411 defining the side edges of the first article engaging tabs 416. Each first arcuate cutline 426 is spaced apart from the second distal end of the linear cutlines 411 so as to define a connecting portion 428 or "nick" between a pair of adjacent first article engaging tabs 416.

The second article engaging tabs 418, 420 are located on the main panel 412 in a region in which the article engaging tabs are subject to the least stress or deformation when an article B is received in the first article retention structure RT1.

A third arcuate (or circumferential) cutline 422 is disposed proximate each of the linear cut lines 411 defining the side edges of the second article engaging tab 420. Each third arcuate cutline 422 is spaced apart from the second distal end of the linear cutlines 411 so as to define a connecting portion 428 or "nick" between a pair of adjacent second article engaging tabs 418, 420. Those connecting portions 428 or "nicks" are provided for maintaining a connection between a pair of adjacent tabs 416, 418, 420 even after an article B is inserted into the aperture A1, A2. The connecting portions 428 connect the respective tab 416, 418, 420 with the next adjacent tab 416, 418, 420, thereby preventing or inhibiting the respective tab 416, 418, 420 from wobbling or rotating about its center axis which when in a blank form, is aligned with a radius of the aperture A1 or at least mitigating against such wobbling or rotation.

A third arcuate cutline 422 is disposed proximate a cut line 411 separating each of the second article engaging tabs 418 from the second article engaging tab 420.

Each third arcuate cutline 422 is spaced apart from the second distal end of the linear cutlines 411 so as to define a connecting portion 428 or "nick" between a respective one of the second article engaging tabs 418 and the second article engaging tab 420.

Each of the first and third arcuate cutlines 426, 422 is arranged symmetrically about the linear cutline with which it is associated whereas each of second arcuate (or circumferential) cutlines 425 is asymmetrically arranged about one of the linear cutlines 11.

The first, second and third arcuate cutlines 426, 425, 422 provide stress relief in the main panel 412 when the first and second article engaging tabs 416, 418, 420 are displaced out of the plane of the main panel 412.

The first arcuate cutlines 426 are larger in dimension than the third arcuate cutlines 422. The first arcuate cutlines 426 comprise a first radius of curvature, the third arcuate cutlines 422 comprise a second radius of curvature; the first radius of curvature is larger than the second radius of curvature.

Each of the second arcuate cutlines 425 are located on the main panel 412 so as to provide a transition between one of the first article engaging tabs 416 and the adjacent second article engaging tab 418. Each of the second arcuate cutlines 425 is arranged asymmetrically about the respective linear cutline 411 with which it is associated. The second cutlines 425 comprise a first portion and a second portion contiguously arranged with each other. The first portion is disposed proximate the first article engaging tab 416 while the second portion is disposed proximate a second article engaging tab 418. The first portion of each of the second cutlines 425 comprises a first radius of curvature while the second portion of each of the second cutlines 425 comprises a second radius of curvature. The first radius of curvature is larger than the second radius of curvature.

The second arcuate cutlines 425 may be considered to comprise one half of a first arcuate cutline 426 and one half of a third arcuate cutline 422 contiguously arranged with each other.

The second cutlines 425 form asymmetrical 'C'-shaped cuts, whereas the first and third cutlines 426, 422 form symmetrical 'C'-shaped cuts. The second cutlines 425 are employed at the boundary between a first area of the main panel 412 that is subject to higher stress upon displacement of the first article engaging tabs 416 and a second area of the main panel 412 that is subject to lower stress upon displacement of the second article engaging tabs 418, 420. The higher stress area of the main panel 412 occurs where the first tabs 416 are located as these first tabs 416 undergo higher bending stress, when an article B is inserted into the respective aperture A1, A2, than the second tabs 418, 420 disposed in the lower stress area of the main panel 412.

Each of the second article engaging tabs 418, 420 is defined in part by a second linear cutline 417 provided in the main panel 412.

Each second linear cutline 417 is disposed between a pair of adjacent arcuate cutlines 422, 422; or 422, 425 in a spaced apart relationship with each of the pair of adjacent arcuate cutlines 422, 422; or 422, 425.

The second linear cutlines 417 each serves as a fold line to facilitates folding of the respective one of the second article engaging tabs 418, 420 with respect to the main panel 412.

In the illustrated embodiment, all the article engaging tabs 416, 418, 420 are equal in size. Optionally, the article engaging tabs 416, 418, 420 may vary in dimension according to their location on the main panel 412. The first article engaging tabs 416 may have a first width, the second article engaging tabs 418 may have a second width and the second article engaging tab 420 may have a third width. The third width may be greater than the second width which in turn may be greater than the first width. In this way, the free end edge, which forms an engaging edge, of each first engaging tab 416 is smaller in length than the free end edge or engaging edge of each second tab 418, 420. In such an optional embodiment, the article engaging tabs 416 located in the region of the main panel 412 and subject to the greater stress or deformation when an article B is received in the article retention structure RT1, RT2 may be less in length than the article engaging tabs 418, 420 located in the region of the main panel 412 subject to the lesser stress or deformation.

The main panel 412 may include at least a paperboard substrate and a tear resistant layer laminated together. It optionally includes an adhesive layer between the paperboard substrate and the tear resistant layer. The material of the paperboard substrate may be selected from any conventional paperboard, for example, ranging in weight upwardly from about 10 pt., preferably from about 11 pt. to about 14 pt. An example of such a substrate is a 12-point SBS board or CNK board manufactured by WestRock Company. The paperboard substrate may be a bleached or unbleached board. The board may be coated on at least one side, optionally the side opposite the lamination, with a conventional coating selected for compatibility with the printing method and board composition.

The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR©, which is a bi-axially oriented polyester, oriented nylon, cross-laminated polyolefin or high density polyolefin. The orientation and cross-laminated structure of these materials contribute to the tear resistant characteristic.

Also, tear resistance may be attributed to the chemical nature of the tear resistant material such as extruded metallocene-catalyzed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low-density polyethylene (LDPE). The adhesive layer may be placed between the substrate and the tear resistant layer to secure the tear resistant layer to the substrate.

Turning to the construction of the carrier 490 from the blank 410, the blank 410 may be applied to two articles B. The blank 410 is lowered with respect to the articles B. Each of the article retention structures RT1, RT2 of the blank 410 are aligned with the neck of the respective article B. The necks of the articles B pass through the respective engaging rings O1, O2 of the main panel 412. The tabs 416, 418, 420 of each of the article retention structures RT1, RT2 are folded out of the plane of the main panel 412 and engage beneath the flange F of the respective article B. Such a flange F may be provided below the cap of the article and above the shoulder of the article. In this way, the tabs 416, 418, 420 grip or hold the respective article B and prevent or inhibit the article B from unintentionally separating from the main panel 412. The assembled carton 490 is shown in FIG. 16.

The present disclosure provides a carrier of the top engaging type having improved article retention structures. In particular, the retention structures comprise article engaging tabs which yield upon insertion of an article. The tabs engage with an article to hold or secure the article within a panel of the carrier. The construction of the tabs is dependent upon the location of the tabs within the panel of the carrier. Those tabs subject to the greatest stress, typically those disposed in the interior regions of the panel or in close proximity to a tab of an adjacent retention structure, are provided with a stress relieving mechanism in the form of cutlines. The cutlines are provided proximate the side edge of the tabs and interrupt or define a foldline between the tab and the panel form which it is struck or formed.

The dimension of a tab may also be dependent upon its location in the panel of the carrier. Those tabs disposed in higher stress areas may be smaller in width than tabs subject to lesser stress.

It will be recognized that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed, a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "aligned with" or "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

TABLE 1

CYCLIC SHAKING TEST RESULTS

| WRK Ref: | | J5487 | Ver. 18 | Ver. 24 | Ver. 24 | Ver. 23 | Ver. 24 | Ver. 18 | Ver. 24 |
|---|---|---|---|---|---|---|---|---|---|
| Condition: | X1 | X2 | X3 | X4 | X5 | X6 | X7 | X8 | X9 |
| Substrate: | Hi-Cone ® | NateraLock ® 28 pt CNK | | | | CarrierKote ® 27 pt CNK | | | |
| Poly or PET | 15 | 1.4 | 1.4 | 2 | 2 | 2 | 2 | 2 | 2 |
| Thickness | mil | mil | mil | mil | mil | mil | mil | mil + 1 | mil + 1 |
| Design | Hi-Cone ® | FIG. 12A | | | | FIG. 12B | | | |
| Structure | FIG. 13A | FIG. 13B | FIG. 13B | FIG. 13C | FIG. 13D | FIG. 13D | FIG. 13E | FIG. 13F | FIG. 13F |
| Rep. 1 | 2 | 2 | 19 | 37 | 35 | 37 | 29 | 100 | 100 |
| Rep. 2 | 2 | 3 | 49 | 21 | 80 | 44 | 49 | 100 | 100 |
| Rep. 3 | 2 | 1 | 26 | 63 | 30 | 40 | 57 | 100 | 100 |
| Rep. 4 | — | 1 | 35 | 60 | 35 | 32 | 51 | 100 | — |
| Rep. 5 | — | 2 | 18 | 17 | 55 | 33 | 88 | 100 | — |
| Rep. 6 | — | — | 29 | 99 | 36 | 34 | — | 100 | — |
| AVG | 2 | 2 | 29 | 50 | 45 | 37 | 55 | 100 | 100 |
| *LowAVG | 2 | 1 | 21 | 25 | 33 | 33 | 43 | 100 | 100 |

*LowAVG = Average of three lowest readings

The invention claimed is:

1. A blank for forming a top engaging carrier for packaging two or more articles, the blank comprising:

a main panel which comprises at least two article retention structures each having an aperture formed through the main panel for receiving a portion of an article; and the main panel further comprising a plurality of tabs formed about a periphery of each of the apertures, each of the apertures defining a first edge of the tabs of the respective apertures and the tabs having a second edge opposing the first edge at a distal end of the tabs, wherein the tabs are hingedly connected to the main panel such that the tabs yield out of the plane of the main panel when an article is received in the respective aperture so as to bear against the article, wherein the second edge of a first tab in at least one of the apertures is defined at least in part by a cutline formed in the main panel at or adjacent to a distal end of the first tab, wherein the cutline defines at least in part the fold line by which the first tab is hinged to the main panel, wherein a second tab in the at least one of the apertures is hingedly connected to the main panel without the cutline formed in the main panel at or adjacent to a distal end of the second tab.

2. The blank according to claim 1 wherein the first tab has a different shape or size or a different shape and size than the second tab based on at least one of: a location of each tab on the main panel, and an amount of stress placed on each tab upon engagement of the article within the aperture.

3. The blank according to claim 1 wherein at least two of the tabs are separated by a cutaway or recess, and wherein at least two other of the tabs are separated by a linear cutline.

4. The blank according to claim 1 wherein the first tab is equal in size to the second tab.

5. The blank according to claim 4 wherein the linear cutline defines in part one of a side edge of a free end edge of at least two other of the tabs.

6. The blank according to claim 1 wherein the main panel comprises a pull tab located adjacent to one of the article retention structures to enable an article being held by the one of the article retention structures to more readily be disengaged from the carrier.

7. The blank according to claim 1, wherein the main panel comprises a handle structure interconnecting the at least two article retention structures.

8. A top engaging carrier for packaging two or more articles comprising:

a main panel which comprises at least two article retention structures each having an aperture formed through the main panel for receiving a portion of an article; and the main panel further comprising a plurality of tabs formed about a periphery of each of the apertures, each of the apertures defining a first edge of the tabs of the respective apertures and the tabs having a second edge opposing the first edge at a distal end of the tabs, wherein the tabs are hingedly connected to the main panel such that the tabs yield out of the plane of the main panel when an article is received in the respective aperture so as to bear against the article, wherein the second edge of a first tab in at least one of the apertures is defined at least in part by a cutline formed in the main panel at or adjacent to a distal end of the first tab, wherein the cutline defines at least in part the fold line by which the first tab is hinged to the main panel, wherein a second tab in the at least one of the apertures is hingedly connected to the main panel without the cutline formed in the main panel at or adjacent to a distal end of the second tab.

9. The top engaging carrier according to claim 8 wherein the first tab has a different shape or size or a different shape and size than the second tab based on at least one of: a location of each tab on the main panel, and an amount of stress placed on each tab upon engagement of the article within the aperture.

10. The top engaging according to claim 8 wherein at least two of the tabs are separated by a cutaway or recess, and wherein at least two other of the tabs are separated by a linear cutline.

11. The top engaging carrier according to claim 8 wherein the first tab is equal in size to the second tab.

12. The top engaging carrier according to claim 8 wherein the main panel comprises a pull tab located adjacent to one of the article retention structures to enable an article being held by the one of the article retention structures to more readily be disengaged from the carrier.

13. The top engaging carrier according to claim 12, wherein the pull tab is located substantially at a corner portion of the main panel.

14. The top engaging carrier according to claim 8 wherein the main panel is defined by a perimeter comprising a concavely curved edge portion that is aligned in a longitudinal or transverse direction with a handle aperture formed in the main panel.

* * * * *